US011105536B2

(12) United States Patent
Suzuki et al.

(10) Patent No.: US 11,105,536 B2
(45) Date of Patent: Aug. 31, 2021

(54) COMBINED HEAT EXCHANGER

(71) Applicant: DENSO CORPORATION, Kariya (JP)

(72) Inventors: Satoshi Suzuki, Kariya (JP); Yoshiki Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 39 days.

(21) Appl. No.: 16/774,139

(22) Filed: Jan. 28, 2020

(65) Prior Publication Data

US 2020/0158380 A1 May 21, 2020

Related U.S. Application Data

(63) Continuation of application No. PCT/JP2018/024484, filed on Jun. 28, 2018.

(30) Foreign Application Priority Data

Jul. 31, 2017 (JP) ..... JP2017-148188

(51) Int. Cl.

| | |
|---|---|
| ***F25B 1/00*** | (2006.01) |
| ***F28D 9/00*** | (2006.01) |
| ***F28F 3/06*** | (2006.01) |
| ***F28F 9/00*** | (2006.01) |

(52) U.S. Cl.

CPC ..... *F25B 1/00* (2013.01); *F28D 9/00* (2013.01); *F28F 3/06* (2013.01); *F28F 9/00* (2013.01)

(58) Field of Classification Search

CPC ..... F25B 1/00; F28D 9/00; F28F 3/06; F28F 9/00

USPC ..... 62/498

See application file for complete search history.

(56) References Cited

U.S. PATENT DOCUMENTS

| | | | | |
|---|---|---|---|---|
| 5,641,016 | A * | 6/1997 | Isaji | B60H 1/00914 165/43 |
| 2005/0061497 | A1 | 3/2005 | Amaral et al. | |
| 2006/0213220 | A1* | 9/2006 | Takahashi | B60H 1/3227 62/503 |
| 2009/0107172 | A1* | 4/2009 | Salim | F25B 43/006 62/503 |

(Continued)

FOREIGN PATENT DOCUMENTS

| | | | |
|---|---|---|---|
| EP | 2174810 | A | 4/2010 |
| JP | 2000018735 | A | 1/2000 |

(Continued)

*Primary Examiner* — Davis D Hwu

(74) *Attorney, Agent, or Firm* — Harness, Dickey & Pierce, P.L.C.

(57) ABSTRACT

A combined heat exchanger includes a heat exchange unit having a plurality of plate-like members stacked together. The heat exchange unit includes a heat absorption evaporation unit and an internal heat exchange unit. The heat absorption evaporation unit includes a heat absorption refrigerant passage, and the internal heat exchange unit includes a high pressure refrigerant passage and a low pressure refrigerant passage. The combined heat exchanger has at least one of a high pressure refrigerant outlet port that allows the refrigerant flowing out of the high pressure refrigerant passage to flow out to a cooling refrigerant passage and a low pressure refrigerant inlet port that allows the refrigerant flowing out of the cooling refrigerant passage to flow into the low pressure refrigerant passage.

9 Claims, 14 Drawing Sheets

(56) References Cited

U.S. PATENT DOCUMENTS

| | | | | |
|---|---|---|---|---|
| 2009/0139781 | A1* | 6/2009 | Straubel | B60L 50/64 180/65.1 |
| 2012/0210746 | A1 | 8/2012 | Kadle et al. | |
| 2012/0216562 | A1 | 8/2012 | Kadle et al. | |
| 2012/0222846 | A1 | 9/2012 | Kadle et al. | |
| 2012/0241139 | A1 | 9/2012 | Katoh et al. | |

FOREIGN PATENT DOCUMENTS

| | | | |
|---|---|---|---|
| JP | 2005504686 | A | 2/2005 |
| JP | 2012207890 | A | 10/2012 |

* cited by examiner

COMBINED HEAT EXCHANGER

CROSS REFERENCE TO RELATED APPLICATION

The present application is a continuation application of International Patent Application No. PCT/JP2018/024484 filed on Jun. 28, 2018, which designated the U.S. and claims the benefit of priority from Japanese Patent Application No. 2017-148188 filed on Jul. 31, 2017. The entire disclosures of all of the above applications are incorporated herein by reference.

TECHNICAL FIELD

The present disclosure relates to a combined heat exchanger for a vapor compression refrigeration cycle apparatus.

BACKGROUND ART

A vapor compression refrigeration cycle apparatus is used in air conditioning of a space to be air-conditioned and temperature control of a secondary battery. The refrigeration cycle apparatus is provided with an indoor condenser and an indoor evaporator which exchange heat between a refrigerant and ventilation air blown to the space to be air-conditioned, an outdoor heat exchanger which exchanges heat between the refrigerant and outside air, and a combined heat exchanger which exchanges heat between the refrigerant and a heating medium flowing into an internal passage of a secondary battery.

SUMMARY

According to an aspect of the present disclosure, a combined heat exchanger is applied to a vapor compression refrigeration cycle apparatus including a compressor that compresses and discharges a refrigerant, a heating unit that heats a fluid to be heat-exchanged using the refrigerant discharged from the compressor as a heat source, and a cooling evaporation unit that absorbs heat of the fluid to be heat-exchanged into the refrigerant to evaporate the refrigerant. The combined heat exchanger includes a heat exchange unit having a plurality of plate-like members stacked and joined together. The heat exchange unit includes a heat absorption evaporation unit that absorbs heat of a heating medium into the refrigerant to evaporate the refrigerant, and an internal heat exchange unit that exchanges heat between the refrigerant flowing out of the heating unit and the refrigerant sucked into the compressor. The heat absorption evaporation unit includes a heat absorption refrigerant passage through which the refrigerant is allowed to flow. The cooling evaporation unit includes a cooling refrigerant passage through which the refrigerant is allowed to flow. The internal heat exchange unit includes a high pressure refrigerant passage through which the refrigerant flowing out of the heating unit is allowed to flow and a low pressure refrigerant passage through which the refrigerant sucked into the compressor is allowed to flow. The heat absorption refrigerant passage and the cooling refrigerant passage are connected parallel to each other. The combined heat exchanger has at least one of a high pressure refrigerant outlet port that allows the refrigerant flowing out of the high pressure refrigerant passage to flow out to the cooling refrigerant passage and a low pressure refrigerant inlet port that allows the refrigerant flowing out of the cooling refrigerant passage to flow into the low pressure refrigerant passage.

DESCRIPTION OF EMBODIMENTS

Figure 1:
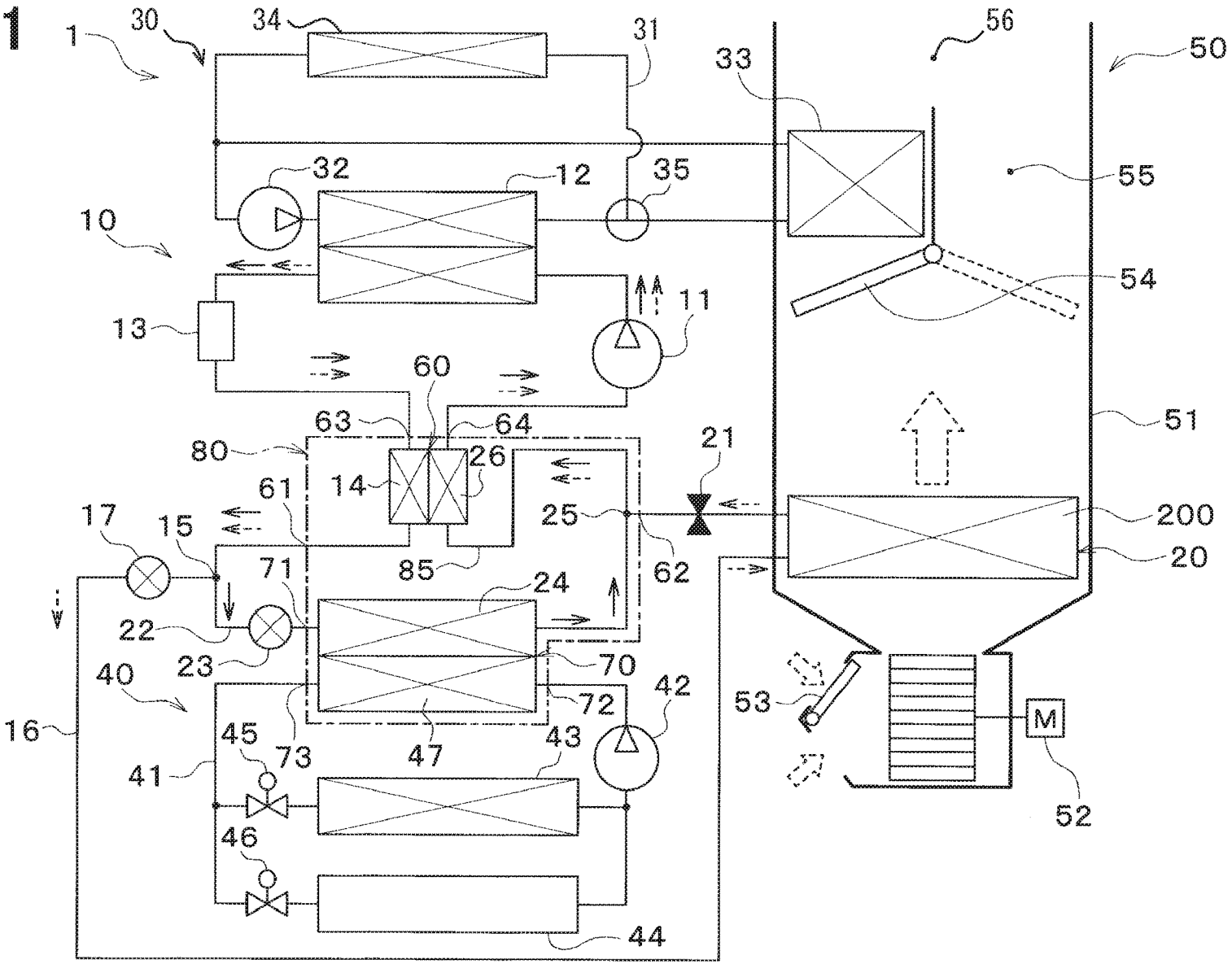
FIG. 1 is a schematic view illustrating a refrigeration cycle apparatus according to a first embodiment.

To begin with, examples of relevant techniques will be described.

A vapor compression refrigeration cycle apparatus is used in air conditioning of a space to be air-conditioned and temperature control of a secondary battery. The refrigeration cycle apparatus is provided with an indoor condenser and an indoor evaporator which exchange heat between a refrigerant and ventilation air blown to the space to be air-conditioned, an outdoor heat exchanger which exchanges heat between the refrigerant and outside air, and a combined heat exchanger which exchanges heat between the refrigerant and a heating medium flowing into an internal passage of a secondary battery.

In the refrigeration cycle apparatus, when heating of the space to be air-conditioned is performed, the outdoor heat exchanger is caused to function as an evaporator to make a switch to a refrigerant circuit that dissipates heat absorbed from outside air to ventilation air blown to the space to be air-conditioned in the indoor condenser. On the other hand, when cooling of the space to be air-conditioned is performed, the outdoor heat exchanger is caused to function as a radiator to make a switch to a refrigerant circuit that dissipates heat absorbed from ventilation air in the indoor evaporator to outside air.

Further, the combined heat exchanger includes a heating heat exchange unit which exchanges heat between a high-pressure refrigerant and the heating medium to heat the heating medium and a cooling heat exchange unit which exchanges heat between a low-pressure refrigerant and the heating medium to cool the heating medium. In the refrigeration cycle apparatus, when the secondary battery is warmed up, a switch to a refrigerant circuit that causes the high-pressure refrigerant to flow into the heating heat exchange unit is made. On the other hand, when the secondary battery is cooled, a switch to a refrigerant circuit that causes the low-pressure refrigerant to flow into the cooling heat exchange unit is made.

As means for improving a coefficient of performance (so-called COP) of a refrigeration cycle apparatus, means in which an internal heat exchanger is added to the refrigeration cycle apparatus can be considered. The internal heat exchanger exchanges heat between a high-pressure refrigerant flowing out of a heat exchanger that functions as a radiator and a low-pressure refrigerant flowing out of a heat exchanger that functions as an evaporator to increase a heat absorption amount of the refrigerant in the heat exchanger that functions as the evaporator.

However, a refrigeration cycle apparatus that performs temperature control of a plurality of fluids to be heat-exchanged such as ventilation air and a heating medium is already provided with a plurality of heat exchangers. Thus, the addition of the internal heat exchanger results in further complication of the cycle configuration.

The present disclosure provides a combined heat exchanger capable of improving the coefficient of performance of a refrigeration cycle apparatus to which the combined heat exchanger is applied without causing complication of the cycle configuration.

According to an aspect of the present disclosure, a combined heat exchanger is applied to a vapor compression refrigeration cycle apparatus including a compressor that compresses and discharges a refrigerant, a heating unit that heats a fluid to be heat-exchanged using the refrigerant discharged from the compressor as a heat source, and a cooling evaporation unit that absorbs heat of the fluid to be heat-exchanged into the refrigerant to evaporate the refrigerant. The combined heat exchanger includes a heat exchange unit having a plurality of plate-like members stacked and joined together. The heat exchange unit includes a heat absorption evaporation unit that absorbs heat of a heating medium into the refrigerant to evaporate the refrigerant, and an internal heat exchange unit that exchanges heat between the refrigerant flowing out of the heating unit and the refrigerant sucked into the compressor. The heat absorption evaporation unit includes a heat absorption refrigerant passage through which the refrigerant is allowed to flow. The cooling evaporation unit includes a cooling refrigerant passage through which the refrigerant is allowed to flow. The internal heat exchange unit includes a high pressure refrigerant passage through which the refrigerant flowing out of the heating unit is allowed to flow and a low pressure refrigerant passage through which the refrigerant sucked into the compressor is allowed to flow. The heat absorption refrigerant passage and the cooling refrigerant passage are connected parallel to each other. The combined heat exchanger has at least one of a high pressure refrigerant outlet port that allows the refrigerant flowing out of the high pressure refrigerant passage to flow out to the cooling refrigerant passage and a low pressure refrigerant inlet port that allows the refrigerant flowing out of the cooling refrigerant passage to flow into the low pressure refrigerant passage.

Accordingly, it is possible to increase the heat absorption amount of the refrigerant in at least one of the cooling evaporation unit and the heat absorption evaporation unit to improve the coefficient of performance of the refrigeration cycle apparatus to which the combined heat exchanger is applied by providing the internal heat exchange unit that exchanges heat between the refrigerant flowing out of the heating unit and the refrigerant sucked into the compressor in the heat exchange unit.

In this case, the combined heat exchanger includes the heat absorption evaporation unit and the internal heat exchange unit, and includes at least one of the high pressure refrigerant outlet port and the low pressure refrigerant inlet port. Thus, the cycle configuration can be simplified even in the refrigeration cycle apparatus provided with the internal heat exchange unit.

Thus, the combined heat exchanger according to the present disclosure makes it possible to improve the coefficient of performance of a refrigeration cycle apparatus to which the combined heat exchanger is applied without causing complication of the cycle configuration.

Hereinafter, embodiments will be described according to the drawings. Same or equivalent portions among respective embodiments below are labeled with same reference numerals in the drawings.

First Embodiment

A first embodiment will be described with reference to FIGS. 1 to 3. A refrigeration cycle apparatus 10 in the first embodiment is applied to a vehicle air conditioner 1 of an electric vehicle which obtains a driving force for vehicle traveling from a traveling electric motor. The refrigeration cycle apparatus 10 has a function of cooling or heating ventilation air blown into a cabin which is a space to be air-conditioned in the vehicle air conditioner 1.

That is, as illustrated in FIG. 1, the refrigeration cycle apparatus 10 according to the first embodiment is capable of switching a plurality of operation modes including a cooling mode which cools the inside of the cabin and a heating mode which heats the inside of the cabin.

In the first embodiment, ventilation air blown into the cabin corresponds to a fluid to be heat-exchanged of the present disclosure. In FIG. 1, a refrigerant flow in the heating mode is indicated by a solid line arrow, and a refrigerant flow in the cooling mode is indicated by a broken line arrow.

Further, the refrigeration cycle apparatus 10 employs an HFC refrigerant (specifically, R134a) as the refrigerant and constitutes a vapor compression subcritical refrigeration cycle in which the high pressure refrigerant pressure does not exceed the critical pressure of the refrigerant. It is needless to say that an HFO refrigerant (e.g., R1234yf) or the like may be employed. A refrigerating machine oil for lubricating a compressor 11 is mixed in the refrigerant. Part of the refrigerating machine oil circulates through the cycle together with the refrigerant.

The refrigeration cycle apparatus 10 according to the first embodiment includes the refrigeration cycle, a heating unit 30, and a heating medium circuit 40. The refrigeration cycle of the refrigeration cycle apparatus 10 includes the compressor 11, a refrigerant radiator 12, a liquid storage unit 13, an internal heat exchange unit 60, a first expansion valve 17, a cooling evaporation unit 20, an evaporation pressure regulating valve 21, a second expansion valve 23, and a heat absorption evaporation unit 70 which are connected to each other.

In the refrigeration cycle apparatus 10, the compressor 11 is an electric compressor that is driven by electric power supplied from a battery, and sucks, compresses, and discharges the refrigerant of the refrigeration cycle apparatus 10. The compressor 11 is configured as an electric compressor that drives a fixed displacement compression mechanism whose discharge capacity is fixed by an electric motor, and housed inside a housing of the vehicle air conditioner 1. Various compression mechanisms such as a scroll compression mechanism and a vane compression mechanism can be employed as the compression mechanism.

The operation (rotation speed) of the electric motor included in the compressor 11 is controlled by a control signal output from an air conditioning controller (not illustrated). Any of an AC motor and a DC motor may be employed as the electric motor. A refrigerant discharge capacity of the compressor 11 is changed by controlling the rotation speed of the electric motor by the air conditioning controller. The compressor 11 may be a variable displacement compressor that is driven by a belt.

A refrigerant inlet side of the refrigerant radiator 12 is connected to a discharge port side of the compressor 11. The refrigerant radiator 12 is a heat exchanger that constitutes a part of the heating unit 30 configured as a heating medium circuit and exchanges heat between a coolant which is a high temperature side heating medium circulating through the heating unit 30 and a high-pressure refrigerant discharged from the compressor 11.

That is, the refrigerant radiator 12 functions as a medium-refrigerant heat exchanger in the present disclosure. The refrigerant radiator 12 dissipates heat of the high-pressure refrigerant discharged from the compressor 11 to the heating medium circulating through the heating unit 30. The configuration of the heating unit 30 and the specific configuration of the heating medium in the heating unit 30 will be described in detail later.

A refrigerant inflow port of the liquid storage unit 13 is connected to a refrigerant outlet side of the refrigerant radiator 12. The liquid storage unit 13 is a receiver (that is, a liquid receiver) that separates the refrigerant flowing out of the refrigerant radiator 12 into gas and liquid and stores a surplus liquid-phase refrigerant.

A refrigerant inlet (that is, a high pressure refrigerant inlet port 63 (described later)) side of a high pressure refrigerant passage 14 in the internal heat exchange unit 60 is connected to a refrigerant outlet of the liquid storage unit 13. The internal heat exchange unit 60 is a heat exchange unit that exchanges heat between a high-pressure refrigerant flowing out of the refrigerant radiator 12 which constitutes a part of the heating unit 30 and a low-pressure refrigerant sucked into the compressor 11. In other words, the internal heat exchange unit 60 is a heat exchange unit that exchanges heat between the high-pressure refrigerant flowing through the high pressure refrigerant passage 14 and the low-pressure refrigerant flowing through a low pressure refrigerant passage 26 (described later). The configuration and the like of the internal heat exchange unit 60 will be described in detail later.

A refrigerant dividing unit 15 is disposed on a refrigerant outlet (that is, a high pressure refrigerant outlet port 61 (described later)) side of the high pressure refrigerant passage 14 in the internal heat exchange unit 60. The refrigerant dividing unit 15 includes one refrigerant inflow port and a plurality of refrigerant outflow ports, and divides the flow of the refrigerant flowing out of the high pressure refrigerant passage 14 of the internal heat exchange unit 60 into a plurality of flows.

The refrigerant dividing unit 15 according to the first embodiment includes two refrigerant outflow ports. One of the refrigerant outflow ports in the refrigerant dividing unit 15 is connected to a first parallel passage 16, and the other refrigerant outflow port is connected to a second parallel passage 22. Thus, the refrigerant dividing unit 15 divides the refrigerant flow flowing out of the high pressure refrigerant passage 14 of the internal heat exchange unit 60 into a refrigerant flow passing through the first parallel passage 16 and a refrigerant flow passing through the second parallel passage 22.

The first expansion valve 17, the cooling evaporation unit 20, and the evaporation pressure regulating valve 21 are disposed on the first parallel passage 16. The first expansion valve 17 includes a valve element having a changeable throttle opening degree and an electric actuator which changes the opening degree of the valve element. The first expansion valve 17 is configured as an electric variable throttle mechanism.

The first expansion valve 17 has a throttle function which sets the valve opening degree to an intermediate opening degree to achieve any refrigerant decompressing action, a fully opening function which sets the valve opening degree to a fully-open opening degree so as to function as a mere refrigerant passage substantially without exhibiting a flow rate controlling action and a refrigerant decompressing action, and a fully closing function which sets the valve opening degree to a fully-closed opening degree to close the refrigerant passage. The operation of the first expansion valve 17 is controlled by a control signal (that is, a control pulse) output from a controller (not illustrated).

Accordingly, the first expansion valve 17 is capable of decompressing the refrigerant flowing into the first parallel passage 16 until the refrigerant becomes a low-pressure refrigerant and causing the low-pressure refrigerant to flow out. Further, the first expansion valve 17 is capable of controlling the flow rate of the refrigerant flowing to the first parallel passage 16 from the refrigerant dividing unit 15. Thus, the first expansion valve 17 is capable of relatively controlling the flow rate of the refrigerant flowing to the second parallel passage 22.

A refrigerant inlet side of the cooling evaporation unit 20 is connected to a refrigerant outflow port of the first expansion valve 17 through the first parallel passage 16. As illustrated in FIG. 1, the cooling evaporation unit 20 is a heat exchanger that is disposed inside an air conditioning case 51 of an indoor air conditioning unit 50 (described later).

The cooling evaporation unit 20 is provided with a cooling refrigerant passage 200 through which the refrigerant is allowed to flow. The cooling evaporation unit 20 evaporates the low-pressure refrigerant flowing through the cooling refrigerant passage 200 so that a heat absorbing action is exhibited to cool ventilation air passing inside the air conditioning case 51. In other words, the cooling evaporation unit 20 is a heat exchange unit that absorbs heat of ventilation air into the refrigerant to evaporate the refrigerant.

An inlet side of the evaporation pressure regulating valve 21 is connected to a refrigerant outlet side of the cooling evaporation unit 20 through the first parallel passage 16. The evaporation pressure regulating valve 21 includes a mechanical mechanism and has a function of regulating a refrigerant evaporation pressure in the cooling evaporation unit 20 to be equal to or higher than a reference pressure capable of reducing frost in the cooling evaporation unit 20 so as to reduce the frost. In other words, the evaporation pressure regulating valve 21 has a function of regulating a refrigerant evaporation temperature in the cooling evaporation unit 20 to be equal to or higher than a reference temperature capable of reducing frost.

The second parallel passage 22 is connected to the other refrigerant outflow port in the refrigerant dividing unit 15.

The second expansion valve 23 and the heat absorption evaporation unit 70 are disposed on the second parallel passage 22. The second expansion valve 23 includes a valve element having a changeable throttle opening degree and an electric actuator which changes the opening degree of the valve element, and is configured as an electric variable throttle mechanism, similarly to the first expansion valve 17.

The second expansion valve 23 is capable of exhibiting a throttle function, a fully opening function, and a fully closing function by appropriately adjusting the valve opening degree between a fully-open state and a fully-closed state, similarly to the first expansion valve 17. The operation of the second expansion valve 23 is controlled by a control signal (that is, a control pulse) output from the controller.

Accordingly, the second expansion valve 23 is capable of decompressing the refrigerant flowing into the second parallel passage 22 until the refrigerant becomes a low-pressure refrigerant and causing the low-pressure refrigerant to flow out. Further, the second expansion valve 23 is capable of controlling the flow rate of the refrigerant flowing to the second parallel passage 22 from the refrigerant dividing unit 15. Thus, the second expansion valve 23 is capable of relatively controlling the flow rate of the refrigerant flowing to the first parallel passage 16.

That is, the first expansion valve 17 and the second expansion valve 23 cooperate with each other to exhibit a function of controlling the flow rate of the refrigerant passing through the first parallel passage 16 and the second parallel passage 22. Further, the first expansion valve 17 and the second expansion valve 23 exhibit a passage switching function by causing either one of the first expansion valve 17 and the second expansion valve 23 to exhibit the fully closing function.

A refrigerant inlet side of the heat absorption evaporation unit 70 is connected to a refrigerant outflow port of the second expansion valve 23 through the second parallel passage 22. As illustrated in FIG. 1, the heat absorption evaporation unit 70 is a heat exchanger that constitutes a part of the heating medium circuit 40 (described later).

The heat absorption evaporation unit 70 is provided with a heat absorption refrigerant passage 24 through which the refrigerant is allowed to flow. The heat absorption evaporation unit 70 evaporates the low-pressure refrigerant flowing through the heat absorption refrigerant passage 24 so that a heat absorbing action is exhibited to absorb heat of a low temperature side heating medium (that is, a coolant) circulating through the heating medium circuit 40. In other words, the heat absorption evaporation unit 70 is a heat exchange unit that absorbs heat of the low temperature side heating medium (that is, the coolant) into the refrigerant to evaporate the refrigerant. The configurations and the like of the heating medium circuit 40 and the heat absorption evaporation unit 70 will be described in detail later.

As illustrated in FIG. 1, a refrigerant merging unit 25 includes a plurality of refrigerant inflow ports and one refrigerant outflow port, and merges the refrigerant flows divided by the refrigerant dividing unit 15 into one flow.

The refrigerant merging unit 25 according to the first embodiment includes two refrigerant inflow ports. One of the refrigerant inflow ports of the refrigerant merging unit 25 is connected to a refrigerant outflow port side of the evaporation pressure regulating valve 21, and the other refrigerant inflow port is connected to a refrigerant outlet side of the heat absorption evaporation unit 70. Thus, the refrigerant merging unit 25 merges a refrigerant flow passing through the first parallel passage 16 and a refrigerant flow passing through the second parallel passage 22 into one refrigerant flow and causes the merged refrigerant flow to flow out.

In this manner, in the refrigeration cycle, the first parallel passage 16 and the second parallel passage 22 are connected parallel to each other. Thus, in the refrigeration cycle, the cooling evaporation unit 20 and the heat absorption evaporation unit 70 are connected parallel to each other. In other words, in the refrigeration cycle, the cooling refrigerant passage 200 and the heat absorption refrigerant passage 24 are connected parallel to each other.

A refrigerant inlet side of the low pressure refrigerant passage 26 in the internal heat exchange unit 60 is connected to the refrigerant outflow port of the refrigerant merging unit 25. A suction port side of the compressor 11 is connected to a refrigerant outlet (that is, a low pressure refrigerant outlet port 64 (described later)) of the low pressure refrigerant passage 26 in the internal heat exchange unit 60.

Next, the configuration of the heating unit 30 according to the first embodiment will be described with reference to FIG. 1. As illustrated in FIG. 1, the heating unit 30 is a high temperature side heating medium circuit including the refrigerant radiator 12 which constitutes a part of the refrigeration cycle, a heating medium circulation passage 31 as a heating medium passage, a pressure pump 32, a heater core 33, a first radiator 34, and a three-way valve 35.

The heating unit 30 is configured by connecting the refrigerant radiator 12, the heater core 33, and the like through the heating medium circulation passage 31 and configured to circulate a coolant as a heating medium inside the heating medium circulation passage 31 by the operation of the pressure pump 32. The coolant in the heating unit 30 is a high temperature side heating medium. For example, a liquid containing at least ethylene glycol, dimethylpolysiloxane or a nanofluid, or antifreeze liquid is used as the coolant.

The pressure pump 32 is a heating medium pump that sucks and discharges the coolant as the high temperature side heating medium and includes an electric pump. The pressure pump 32 pressure-feeds the coolant inside the heating medium circulation passage 31 to circulate the coolant inside the heating medium circulation passage 31 of the heating unit 30.

The operation of the pressure pump 32 is controlled by a control signal output from the controller. That is, the pressure pump 32 is capable of controlling the flow rate of the coolant circulating through the heating unit 30 and functions as a heating medium flow rate control unit in the heating unit 30 by the control of the controller.

The refrigerant radiator 12 is connected to a discharge port side of the pressure pump 32. Thus, the refrigerant radiator 12 is capable of dissipating heat of the high-pressure refrigerant passing through the inside of the refrigerant radiator 12 to the coolant circulating through the heating medium circulation passage 31 by heat exchange between the high-pressure refrigerant and the coolant.

The three-way valve 35 is connected to a coolant outflow port side of the refrigerant radiator 12. The three-way valve 35 includes two outflow ports, and is capable of switching the flow of the coolant flowing into the three-way valve 35 from one inflow port to either of the outflow ports.

As illustrated in FIG. 1, the heater core 33 is connected to one of the outflow ports of the three-way valve 35, and the first radiator 34 is connected to the other outflow port. Thus, the three-way valve 35 is capable of switching the flow of the coolant passing through the refrigerant radiator 12 to either the heater core 33 side or the first radiator 34 side. The three-way valve 35 functions as a heating medium passage switching unit in the heating unit 30.

As illustrated in FIG. 1, the heater core 33 is disposed on the downstream side in the ventilation air flow relative to the cooling evaporation unit 20 inside the air conditioning case 51 of the indoor air conditioning unit 50. The heater core 33 is a high temperature side heating medium heat exchanger that exchanges heat between the coolant circulating through the heating medium circulation passage 31 of the heating unit 30 and ventilation air blown into the cabin to heat the ventilation air. In other words, the heater core 33 is a heating heat exchanger that indirectly exchanges heat between the refrigerant discharged from the compressor 11 and ventilation air through the coolant circulating through the heating medium circulation passage 31 to heat the ventilation air with heat of the refrigerant discharged from the compressor 11.

In the heater core 33, the coolant dissipates heat by a sensible heat change to ventilation air blown into the cabin. Accordingly, the ventilation air blown into the cabin of the electric vehicle is heated. Thus, the refrigeration cycle apparatus 10 is capable of heating the inside of the cabin. In the heater core 33, even when the coolant dissipates heat to the ventilation air, the coolant does not change in phase, but remains in the liquid phase.

The first radiator 34 is a radiation heat exchanger that exchanges heat between the coolant circulating through the heating medium circulation passage 31 of the heating unit 30 and outside air outside the electric vehicle to dissipate heat of the coolant to the outside air. The first radiator 34 is connected in parallel to the heater core 33 in the heating medium circulation passage 31 of the heating unit 30. Heat of the coolant is dissipated to the outside air from the first radiator 34. Thus, the refrigeration cycle apparatus 10 is capable of discharging heat to the outside of the cabin without heating the ventilation air.

With such a configuration, the heating unit 30 of the refrigeration cycle apparatus 10 is capable of changing a use mode of heat of the high-pressure refrigerant by switching the flow of the coolant by the three-way valve 35. That is, the heating unit 30 is capable of using heat of the high-pressure refrigerant for heating ventilation air to heat the inside of the cabin by making a switch to a coolant flow through the heater core 33. On the other hand, the heating unit 30 is capable of discharging heat of the high-pressure refrigerant to outside air by making a switch to a coolant flow through the first radiator 34.

Next, the configuration of the heating medium circuit 40 according to the first embodiment will be described with reference to FIG. 1. As illustrated in FIG. 1, the heating medium circuit 40 is a low temperature side heating medium circuit including the heat absorption evaporation unit 70 which constitutes a part of the refrigeration cycle, a heating medium circulation passage 41 as a heating medium passage, a pressure pump 42, a second radiator 43, an onboard device 44, a first on-off valve 45, and a second on-off valve 46.

The heating medium circuit 40 is configured by connecting the heat absorption evaporation unit 70, the second radiator 43, and the like through the heating medium circulation passage 41 and configured to circulate a coolant as a heating medium inside the heating medium circulation passage 41 by the operation of the pressure pump 42. The coolant in the heating medium circuit 40 is a low temperature side heating medium. For example, a liquid containing at least ethylene glycol, dimethylpolysiloxane or a nanofluid, or antifreeze liquid is used as the coolant.

The pressure pump 42 is a heating medium pump that sucks and discharges the coolant as the heating medium and includes an electric pump. The pressure pump 42 pressure-feeds the coolant inside the heating medium circulation passage 41 to circulate the coolant inside the heating medium circulation passage 41 of the heating medium circuit 40.

The operation of the pressure pump 42 is controlled by a control signal output from the controller. That is, the pressure pump 42 is capable of controlling the flow rate of the coolant circulating through the heating medium circuit 40 and functions as a heating medium flow rate control unit in the heating medium circuit 40 by the control of the controller.

The heat absorption evaporation unit 70 is provided with a coolant passage 47 through which the coolant as the heating medium is allowed to flow. A coolant inflow port (that is, a coolant inlet port 72 (described later)) side of the coolant passage 47 in the heat absorption evaporation unit 70 is connected to a discharge port side of the pressure pump 42. Thus, the heat absorption evaporation unit 70 is capable of causing the low-pressure refrigerant flowing through the heat absorption refrigerant passage 24 to absorb heat of the coolant flowing through the coolant passage 47 by heat exchange between the low-pressure refrigerant and the coolant.

A heating medium passage including the second radiator 43 and the like and a heating medium passage including the onboard device 44 and the like are connected to a coolant outflow port (that is, a coolant outlet port 73 (described later)) side of the heat absorption evaporation unit 70. That is, in the heating medium circuit 40 according to the first embodiment, the second radiator 43 and the first on-off valve 45 are connected in parallel to the onboard device 44 and the second on-off valve 46.

The second radiator 43 is a heat absorption heat exchanger that exchanges heat between the coolant circulating through the heating medium circulation passage 41 of the heating medium circuit 40 and outside air outside the electric vehicle to cause the coolant to absorb heat of the outside air. That is, when the coolant is circulated through the second radiator 43, the heating medium circuit 40 uses outside air outside the electric vehicle as an external heat source.

The first on-off valve 45 is disposed on the upstream side in the coolant flow of a coolant inflow port of the second radiator 43. The first on-off valve 45 is capable of adjusting the opening degree of the coolant passage leading to the coolant inflow port of the second radiator 43 between a fully-closed state and a fully-open state. The operation of the first on-off valve 45 is controlled by a control signal output from the controller.

That is, the heating medium circuit 40 is capable of switching the presence or absence of a coolant flow with respect to the second radiator 43 by controlling the opening degree of the first on-off valve 45 by the controller. In other words, the refrigeration cycle apparatus 10 is capable of switching whether to use outside air as the external heat source or not.

The onboard device 44 is mounted on the electric vehicle and includes a device that generates heat along with operation. For example, the onboard device 44 includes a charger for charging a battery of the electric vehicle, a motor generator, and an inverter. The onboard device 44 functions as a heat generating device in the present disclosure. Further, the heating medium circulation passage 41 in the heating medium circuit 40 is disposed in contact with the outer surface of the onboard device 44 so that heat exchange can be performed between the onboard device 44 and the coolant flowing through the heating medium passage.

The second on-off valve 46 is disposed on the upstream side in the coolant flow of a coolant inflow port of the onboard device 44. The second on-off valve 46 is capable of adjusting the opening degree of the coolant passage leading to the coolant inflow port of the onboard device 44 between a fully-closed state and a fully-open state. The operation of the second on-off valve 46 is controlled by a control signal output from the controller.

That is, the heating medium circuit 40 is capable of switching the presence or absence of a coolant flow with respect to the onboard device 44 by controlling the opening degree of the second on-off valve 46 by the controller. In other words, the refrigeration cycle apparatus 10 is capable of switching whether to use the onboard device 44 as the external heat source or not.

Next, the configuration of the indoor air conditioning unit 50 included in the vehicle air conditioner 1 will be described with reference to FIG. 1. The indoor air conditioning unit 50 constitutes a part of the vehicle air conditioner 1 and blows ventilation air having a temperature controlled by the refrigeration cycle apparatus 10 into the cabin.

The indoor air conditioning unit 50 is disposed inside an instrument panel on the foremost part of the cabin in the electric vehicle. The indoor air conditioning unit 50 includes the air conditioning case 51 which forms an outer shell of the indoor air conditioning unit 50, and an air blower 52, the heat absorption evaporation unit 70, and the heater core 33 which are housed inside an air passage formed in the air conditioning case 51.

The air conditioning case 51 forms the air passage for ventilation air blown into the cabin. The air conditioning case 51 is molded using resin having a certain degree of elasticity and high strength (e.g., polypropylene).

An inside and outside air switching device 53 is disposed on the most upstream side in the ventilation air flow of the air conditioning case 51. The inside and outside air switching device 53 introduces inside air (that is, air inside the cabin) and outside air (that is, air outside the cabin) into the air conditioning case 51 in a switching manner.

Specifically, the inside and outside air switching device 53 continuously adjusts the open area of an inside air inlet port for introducing inside air into the air conditioning case 51 and the open area of an outside air inlet port for introducing outside side into the air conditioning case 51 by using an inside and outside air switching door to change the ratio between the volume of inside air to be introduced and the volume of outside air to be introduced. The inside and outside air switching door is driven by an electric actuator for the inside and outside air switching door. The operation of the electric actuator is controlled by a control signal output from the controller.

The air blower 52 is disposed on the downstream side in the ventilation air flow of the inside and outside air switching device 53. The air blower 52 is an electric air blower that drives a centrifugal multi-blade fan by an electric motor and blows air sucked through the inside and outside air switching device 53 into the cabin. A rotation speed (that is, an air blowing capacity) of the air blower 52 is controlled by a control voltage output from the controller.

The cooling evaporation unit 20 and the heater core 33 are disposed in this order with respect to the ventilation air flow on the downstream side in the ventilation air flow of the air blower 52. That is, the cooling evaporation unit 20 is disposed on the upstream side in the ventilation air flow relative to the heater core 33.

A bypass passage 55 is formed inside the air conditioning case 51. The bypass passage 55 is configured to detour ventilation air that has passed through the cooling evaporation unit 20 around the heater core 33.

An air mix door 54 is disposed on the downstream side in the ventilation air flow of the cooling evaporation unit 20 and upstream side in the ventilation air flow of the heater core 33 inside the air conditioning case 51. The air mix door 54 is an air volume ratio adjusting unit that adjusts an air volume ratio, in ventilation air that has passed through the cooling evaporation unit 20, between the volume of ventilation air passing through the heater core 33 side and the volume of ventilation air passing through the bypass passage 55.

The air mix door 54 is driven by an electric actuator for the air mix door. The operation of the electric actuator is controlled by a control signal output from the controller.

A merging space 56 is formed on the downstream side in the ventilation air flow of the heater core 33 and the bypass passage 55. The merging space 56 is formed so that ventilation air heated by heat exchange with the heating medium (that is, the coolant) in the heater core 33 and ventilation air passing through the bypass passage 55 without being heated are merged with each other. Thus, the temperature of the ventilation air merged in the merging space 56 is controlled by adjusting the air volume ratio by the air mix door 54.

Although not illustrated, a plurality of types of open holes are disposed on the most downstream part in the ventilation air flow of the air conditioning case 51. Specifically, a defroster open hole, a face open hole, and a foot open hole are formed as the plurality of types of open holes so that the ventilation air temperature-controlled in the merging space 56 is blown into the cabin through different positions in the cabin.

Further, doors for adjusting the open areas of the respective open holes are disposed on the upstream side in the ventilation air flow of the respective open holes. Specifically, a defroster door, a face door, and a foot door are disposed corresponding to the defroster open hole, the face open hole, and the foot open hole, respectively. The operation of each of the doors is controlled by a control signal of the controller. Each of the doors constitutes a blowoff mode switching device that switches a blowoff mode by opening and closing the corresponding open hole.

Next, the configuration of a control system of the vehicle air conditioner 1 according to the first embodiment will be described. The controller includes a known microcomputer including a CPU, a ROM and a RAM, and a peripheral circuit thereof. The controller performs various operations and processes in accordance with an air conditioning control program stored in the ROM to control the operations of various air conditioning control devices connected to an output side of the controller.

A plurality of types of air conditioning control devices and electric actuators are connected to the output side of the controller. The plurality of types of air conditioning control devices include the compressor 11, the first expansion valve 17, the second expansion valve 23, the air blower 52, the inside and outside air switching device 53, the air mix door 54, the pressure pump 32, the three-way valve 35, the pressure pump 42, the first on-off valve 45, and the second on-off valve 46.

An operation panel (not illustrated) used in various input operations is connected to an input side of the controller. The operation panel is disposed near the instrument panel in the front part of the cabin, and includes various operation switches. Thus, operation signals from the various operation switches disposed on the operation panel are input to the controller.

The various operation switches of the operation panel include an automatic switch, an operation mode selector switch, an air volume setting switch, a temperature setting switch, and a blowoff mode selector switch. Thus, the refrigeration cycle apparatus 10 is capable of appropriately switching the operation mode of the refrigeration cycle apparatus 10 by accepting input by the operation panel.

Further, an air conditioning control sensor group (not illustrated) is connected to the input side of the controller. The air conditioning control sensor group includes an inside air temperature sensor, an outside air temperature sensor, and a solar radiation sensor. The inside air temperature sensor is an inside air temperature detection unit that detects a temperature inside the cabin (that is, the inside air temperature). The outside air temperature sensor is an outside air temperature detection unit that detects a temperature outside the cabin (that is, the outside air temperature). The solar radiation sensor is a solar radiation amount detection unit that detects the amount of solar radiation into the cabin.

Thus, detection signals of the air conditioning control sensor group are input to the controller. Accordingly, the refrigeration cycle apparatus 10 is capable of controlling the temperature of ventilation air blown into the cabin corresponding to a physical quantity detected by the air conditioning control sensor group and achieving comfortable air conditioning.

Next, the operation of the vehicle air conditioner 1 configured as described above will be described. The vehicle air conditioner 1 according to the first embodiment is capable of executing a cooling mode and a heating mode as the operation mode.

The cooling mode is an operation mode that cools ventilation air as a fluid to be heat-exchanged to cool the inside of the cabin. The heating mode is an operation mode that absorbs heat from outside air as the external heat source to heat ventilation air as a fluid to be heat-exchanged to heat the inside of the cabin.

First, an operating mode in the cooling mode of the vehicle air conditioner 1 according to the first embodiment will be described with reference to the drawings. In the cooling mode, the throttle opening degree of the first expansion valve 17 is determined to be a predetermined cooling mode opening degree which is previously determined. The throttle opening degree of the second expansion valve 23 is determined to be a fully-closed state. Accordingly, a switch to the refrigerant circuit indicated by a broken line arrow in FIG. 1 is made.

A control signal output to a servomotor of the air mix door 54 is determined so that the air mix door 54 closes the upstream side in the ventilation air flow of the heater core 33 so as to cause the entire ventilation air that has passed through the cooling evaporation unit 20 to pass through the bypass passage 55. Control signals to the compressor 11, the air blower 52, and the inside and outside air switching device 53 are appropriately determined using an input operation of the operation panel and detection signals of the sensor group.

Thus, in the cooling mode in the refrigeration cycle apparatus 10, the high-pressure refrigerant discharged from the compressor 11 flows into the refrigerant radiator 12. The refrigerant flowing into the refrigerant radiator 12 dissipates heat to the coolant flowing through the heating medium circulation passage 31 of the heating unit 30. Thus, the coolant in the heating unit 30 is heated by heat of the high-pressure refrigerant, and the refrigerant radiator 12 functions as a radiator.

The refrigerant flowing out of the refrigerant radiator 12 flows into the high pressure refrigerant passage 14 of the internal heat exchange unit 60 through the liquid storage unit 13. The high-pressure refrigerant flowing into the high pressure refrigerant passage 14 of the internal heat exchange unit 60 exchanges heat with the low-pressure refrigerant flowing through the low pressure refrigerant passage 26 of the internal heat exchange unit 60 and reaches the refrigerant dividing unit 15.

In the cooling mode, the first expansion valve 17 is in a throttled state, and the second expansion valve 23 is in a fully-closed state. Thus, the refrigerant flowing out of the refrigerant dividing unit 15 flows into the first parallel passage 16, and the refrigerant is isenthalpically decompressed until the refrigerant becomes a low-pressure refrigerant in the first expansion valve 17.

The low-pressure refrigerant flowing out of the first expansion valve 17 flows into the cooling evaporation unit 20 which is disposed inside the air conditioning case 51, and exchanges heat with ventilation air blown by the air blower 52 to absorb heat. Accordingly, the ventilation air from the air blower 52 is cooled, and blown into the cabin through the bypass passage 55.

The refrigerant flowing out of the cooling evaporation unit 20 flows into the low pressure refrigerant passage 26 of the internal heat exchange unit 60 through the evaporation pressure regulating valve 21 and the refrigerant merging unit 25. The low-pressure refrigerant flowing into the low pressure refrigerant passage 26 of the internal heat exchange unit 60 exchanges heat with the high-pressure refrigerant flowing through the high pressure refrigerant passage 14 of the internal heat exchange unit 60. Then, the refrigerant is sucked into the compressor 11 and compressed again.

Hereinbelow, the operation of the heating unit 30 in the cooling mode will be described. A control signal of the three-way valve 35 in the cooling mode is determined so that the entire coolant flowing out of the refrigerant radiator 12 flows into the first radiator 34.

As described above, heat of the high-pressure refrigerant is dissipated to the coolant of the heating unit 30 in the refrigerant radiator 12. Thus, the coolant flowing out of the refrigerant radiator 12, the coolant being kept in a high temperature state, passes through the three-way valve 35, and flows into the first radiator 34.

Heat of the coolant flowing into the first radiator 34 is dissipated to outside air outside the electric vehicle through the first radiator 34. That is, according to the refrigeration cycle apparatus 10, heat of the high-pressure refrigerant is dissipated to outside air through the coolant of the heating unit 30.

Then, the coolant whose heat has been dissipated in the first radiator 34 circulates along with the operation of the pressure pump 32. Then, the coolant is sucked into the pressure pump 32 again, and pressure-fed to the refrigerant radiator 12.

In the cooling mode, the low-pressure refrigerant in the refrigeration cycle apparatus 10 does not pass through the heat absorption evaporation unit 70. Thus, an operating state of the heating medium circuit 40 which is thermally connected to the heat absorption evaporation unit 70 can be determined in any manner.

In this manner, in the cooling mode, it is possible to dissipate heat of the high-pressure refrigerant to outside air through the coolant of the heating unit 30 and cause the low-pressure refrigerant to absorb heat of ventilation air blown into the cabin in the cooling evaporation unit 20 to perform cooling. Accordingly, it is possible to achieve cooling inside the cabin.

Further, in the cooling mode, heat is exchanged between the high-pressure refrigerant flowing out of the refrigerant radiator 12 and the low-pressure refrigerant flowing out of the cooling evaporation unit 20 in the internal heat exchange unit 60 to cause the low-pressure refrigerant to absorb heat of the high-pressure refrigerant to cool the low-pressure refrigerant. Thus, the enthalpy of the inlet side refrigerant of the cooling evaporation unit 20 is reduced. Thus, it is possible to increase the enthalpy difference between the outlet side refrigerant and the inlet side refrigerant of the cooling evaporation unit 20 (in other words, the refrigeration capacity) to improve the coefficient of performance (so-called COP) of the cycle.

Next, an operating mode in the heating mode of the vehicle air conditioner 1 according to the first embodiment will be described with reference to the drawings. In the heating mode, the throttle opening degree of the second expansion valve 23 is determined to be a predetermined heating mode opening degree which is previously determined. The throttle opening degree of the first expansion valve 17 is determined to be a fully-closed state. Accordingly, a switch to the refrigerant circuit indicated by a solid line arrow in FIG. 1 is made.

A control signal output to the servomotor of the air mix door 54 is determined so that the air mix door 54 closes bypass passage 55 so as to cause the entire ventilation air that has passed through the cooling evaporation unit 20 to pass through the heater core 33. Control signals to the compressor 11, the air blower 52, and the inside and outside air switching device 53 are appropriately determined using an input operation of the operation panel and detection signals of the sensor group.

Thus, in the heating mode in the refrigeration cycle apparatus 10, the high-pressure refrigerant discharged from the compressor 11 flows into the refrigerant radiator 12. The refrigerant flowing into the refrigerant radiator 12 dissipates heat to the coolant flowing through the heating medium circulation passage 31 of the heating unit 30. Thus, the coolant in the heating unit 30 is heated by heat of the high-pressure refrigerant, and the refrigerant radiator 12 functions as a radiator.

Also in the heating mode, the refrigerant flowing out of the refrigerant radiator 12 flows into the high pressure refrigerant passage 14 of the internal heat exchange unit 60 through the liquid storage unit 13. The high-pressure refrigerant flowing into the high pressure refrigerant passage 14 of the internal heat exchange unit 60 exchanges heat with the low-pressure refrigerant flowing through the low pressure refrigerant passage 26 of the internal heat exchange unit 60 and reaches the refrigerant dividing unit 15.

In the heating mode, the second expansion valve 23 is in a throttled state, and the first expansion valve 17 is in a fully-closed state. Thus, the refrigerant flowing out of the refrigerant dividing unit 15 flows into the second parallel passage 22, and the refrigerant is isenthalpically decompressed until the refrigerant becomes a low-pressure refrigerant in the second expansion valve 23.

The low-pressure refrigerant flowing out of the second expansion valve 23 flows into the heat absorption evaporation unit 70, and exchanges heat with the coolant circulating through the heating medium circuit 40. That is, in the heat absorption evaporation unit 70, the low-pressure refrigerant is heated by absorbing heat of the coolant of the heating medium circuit 40, and the coolant of the heating medium circuit 40 is cooled by heat exchange with the low-pressure refrigerant.

Also in the heating mode, the refrigerant flowing out of the heat absorption evaporation unit 70 flows into the low pressure refrigerant passage 26 of the internal heat exchange unit 60 through the refrigerant merging unit 25. The low-pressure refrigerant flowing into the low pressure refrigerant passage 26 of the internal heat exchange unit 60 exchanges heat with the high-pressure refrigerant flowing through the high pressure refrigerant passage 14 of the internal heat exchange unit 60. Then, the refrigerant is sucked into the compressor 11 and compressed again.

Hereinbelow, the operation of the heating unit 30 in the heating mode will be described. A control signal of the three-way valve 35 in the heating mode is determined so that the entire coolant flowing out of the refrigerant radiator 12 flows into the heater core 33.

As described above, heat of the high-pressure refrigerant is dissipated to the coolant of the heating unit 30 in the refrigerant radiator 12. Thus, the coolant flowing out of the refrigerant radiator 12, the coolant being kept in a high temperature state, passes though the three-way valve 35, and flows into the heater core 33.

The coolant flowing into the heater core 33 exchanges heat with ventilation air blown by the air blower 52 in the heater core 33. In the heating mode, the first expansion valve 17 is in a fully-closed state. Thus, the ventilation air reaches the heater core 33 without being cooled by the cooling evaporation unit 20.

That is, according to the refrigeration cycle apparatus 10, heat of the high-pressure refrigerant is dissipated to the ventilation air blown into the cabin through the coolant of the heating unit 30. Accordingly, it is possible to supply the ventilation air heated by heat of the high-pressure refrigerant into the cabin to heat the inside of the cabin.

The coolant whose heat has been dissipated in the heater core 33 circulates along with the operation of the pressure pump 32. Then, the coolant is sucked into the pressure pump 32 again, and pressure-fed to the refrigerant radiator 12.

Next, the operation of the heating medium circuit 40 in the heating mode will be described. Control signals of the first on-off valve 45 and the second on-off valve 46 in the heating mode are determined so that, for example, the first on-off valve 45 is fully open and the second on-off valve 46 is fully closed. In this case, the entire coolant in the heating medium circuit 40 passes through the second radiator 43. Thus, the coolant absorbs heat from outside air in the second radiator 43. That is, the refrigeration cycle apparatus 10 in this case uses outside air as the external heat source.

The coolant flowing out of the second radiator 43 flows into the heat absorption evaporation unit 70 through the pressure pump 42 by the operation of the pressure pump 42. As described above, in the heat absorption evaporation unit 70, heat exchange is performed between the low-pressure refrigerant and the coolant of the heating medium circuit 40. Thus, heat of the coolant in the heating medium circuit 40 is absorbed into the low-pressure refrigerant. Accordingly, the refrigeration cycle apparatus 10 can use outside air as the external heat source in the heating mode.

In the example described above, the first on-off valve 45 is fully open, and the second on-off valve 46 is fully closed. Thus, the coolant passes through the second radiator 43. That is, the above example is a mode that uses outside air as the external heat source in the heating mode. However, various modes can be employed as a use mode of the external heat source depending on on-off control of the first on-off valve 45 and the second on-off valve 46.

For example, when the first on-off valve 45 is fully closed, and the second on-off valve 46 is fully open, the coolant passes through the onboard device 44. Thus, the coolant absorbs heat of the onboard device 44. In this case, the refrigeration cycle apparatus 10 can use the onboard device 44 as the external heat source in the heating mode.

Further, when the first on-off valve 45 and the second on-off valve 46 are fully open, flows of the coolant merge with each other after passing through the second radiator 43 and the onboard device 44. Thus, the coolant can absorb heat of outside air and heat of the onboard device 44. In this case, the refrigeration cycle apparatus 10 can use outside air and the onboard device 44 in combination as the external heat source in the heating mode.

In this manner, in the heating mode, it is possible to cause the low-pressure refrigerant to absorb heat of the external heat source (that is, outside air or the onboard device 44) through the coolant of the heating medium circuit 40, and dissipate heat of the high-pressure refrigerant to ventilation air blown into the cabin through the coolant of the heating unit 30 to perform heating. Accordingly, it is possible to achieve heating inside the cabin.

Further, in the heating mode, the internal heat exchange unit 60 exchanges heat between the high-pressure refrigerant flowing out of the refrigerant radiator 12 and the low-pressure refrigerant flowing out of the heat absorption evaporation unit 70 to cause the low-pressure refrigerant to absorb heat of the high-pressure refrigerant to cool the low-pressure refrigerant. Thus, the enthalpy of the inlet side refrigerant of the heat absorption evaporation unit 70 is reduced. Thus, it is possible to increase the enthalpy difference between the outlet side refrigerant and the inlet side refrigerant of the heat absorption evaporation unit 70 (in other words, the refrigeration capacity) to improve the coefficient of performance (so-called COP) of the cycle.

Next, the detailed configurations of the heat absorption evaporation unit 70 and the internal heat exchange unit 60 in the refrigeration cycle apparatus 10 according to the first embodiment will be described with reference to FIGS. 2 and 3. In FIG. 2, the flow of the high-pressure refrigerant is indicated by a solid line arrow, the flow of the low-pressure refrigerant is indicated by a broken line arrow, and the flow of the coolant is indicated by a dot-dash line arrow.

Figure 2:
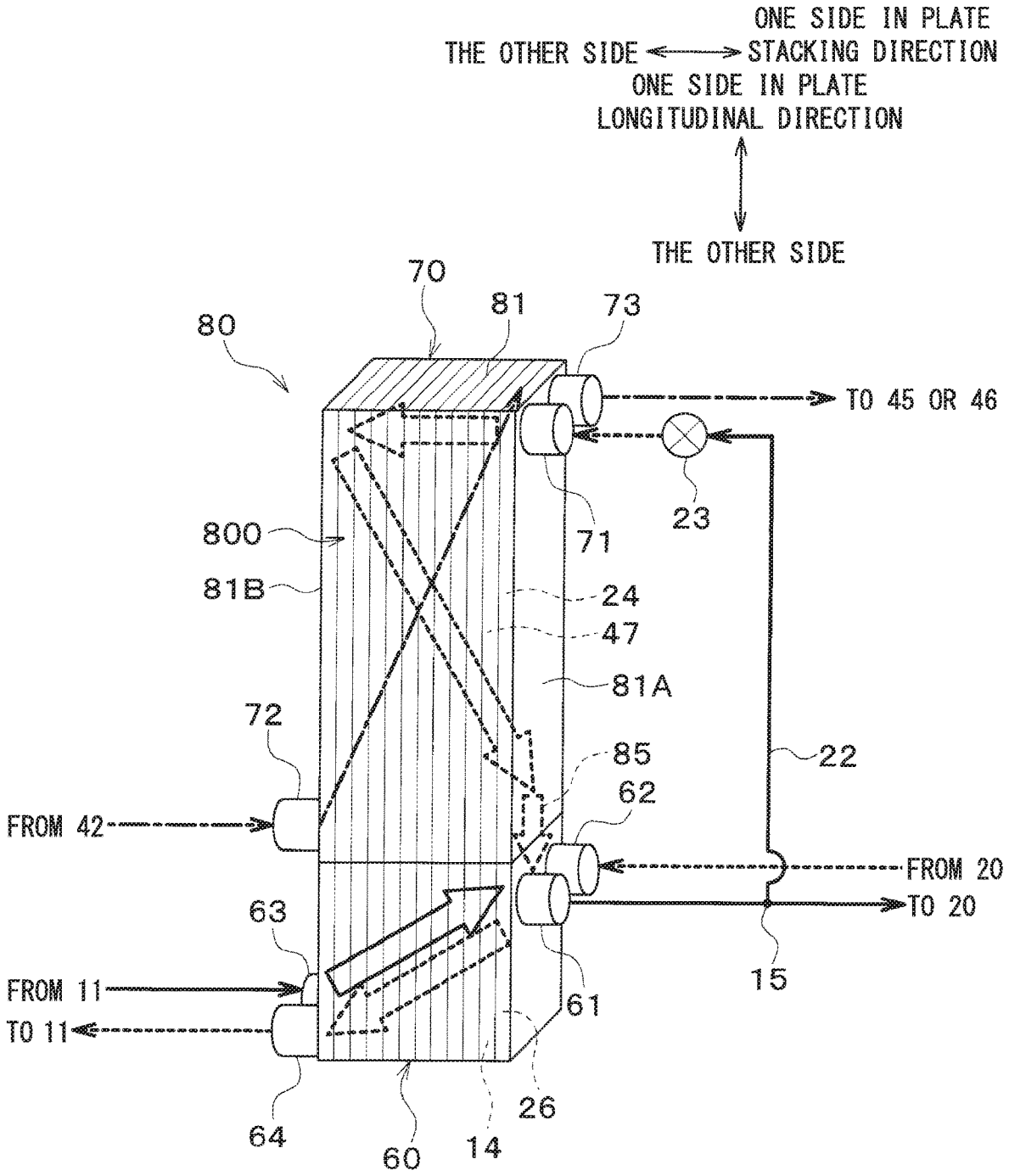
FIG. 2 is a view illustrating a combined heat exchanger of the first embodiment.

As illustrated in FIG. 2, the refrigeration cycle apparatus 10 is provided with a combined heat exchanger 80 in which the heat absorption evaporation unit 70 and the internal heat exchange unit 60 are integrated together. In other words, the refrigeration cycle apparatus 10 is provided with the combined heat exchanger 80 which includes the heat absorption evaporation unit 70 and the internal heat exchange unit 60.

The combined heat exchanger 80 is provided with a heat exchange unit 800 including a plurality of plate-like members 81 which are stacked and joined together. The heat exchange unit 800 includes the heat absorption evaporation unit 70 and the internal heat exchange unit 60. That is, a part of the heat exchange unit 800 constitutes the heat absorption evaporation unit 70 and the rest part of the heat exchange unit 800 constitutes the internal heat exchange unit 60.

Hereinbelow, the longitudinal direction of the plurality of plate-like members 81 (the up-down direction in the example of FIG. 2) is referred to as a plate longitudinal direction, and a stacking direction of the plurality of plate-like members 81 (the left-right direction in the example of FIG. 2) is referred to as a plate stacking direction. One side in the plate stacking direction, that is, one end side in the plate stacking direction (the left end side in the example of FIG. 2) is referred to as the plate stacking direction one side. The other side in the plate stacking direction, that is, the other end side in the plate stacking direction (the right end side in the example of FIG. 2) is referred to as the plate stacking direction other side. The plate stacking direction is perpendicular to the plate surface of the plate-like member 81.

The heat absorption evaporation unit 70 and the internal heat exchange unit 60 are disposed side by side in the direction perpendicular to the plate stacking direction. Specifically, the heat absorption evaporation unit 70 and the internal heat exchange unit 60 are disposed side by side in the plate longitudinal direction.

The size of the heat absorption evaporation unit 70 differs from the size of the internal heat exchange unit 60. Specifically, the length in the plate longitudinal direction of the heat absorption evaporation unit 70 is longer than the length in the plate longitudinal direction of the internal heat exchange unit 60.

The plate-like member 81 is a plate member having an elongated quadrangular shape (that is, a rectangular shape). As a specific material of the plate-like member 81, for example, a double-sided clad material including an aluminum core material cladded with a brazing material on both faces thereof is used.

Figure 3:
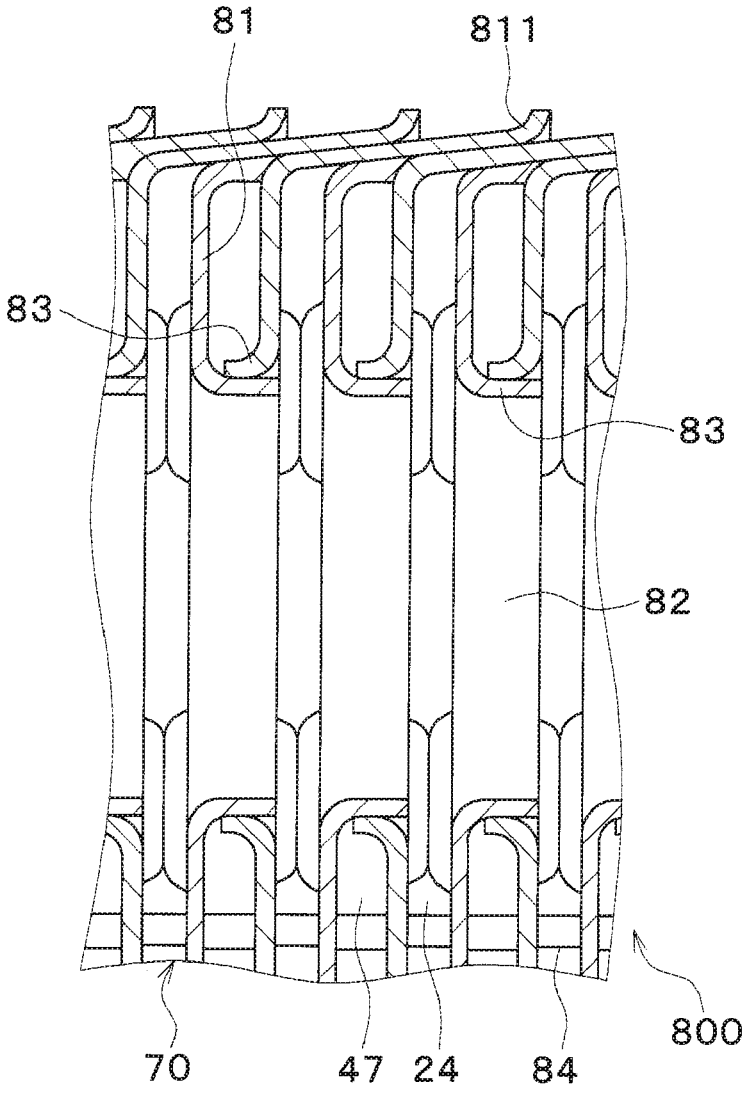
FIG. 3 is an enlarged view illustrating a part of the combined heat exchanger of the first embodiment.

As illustrated in FIG. 3, an overhang part 811 which projects in the plate stacking direction is formed on the outer peripheral edge of the plate-like member 81. The overhang parts 811 are joined to each other by brazing with the plurality of plate-like members 81 stacked on each other.

As illustrated in FIGS. 2 and 3, the heat absorption evaporation unit 70 includes a plurality of heat absorption refrigerant passages 24 through which the refrigerant is allowed to flow and a plurality of coolant passages 47 through which the coolant is allowed to flow. The heat absorption refrigerant passages 24 and the coolant passages 47 are formed between the plurality of plate-like members 81. The longitudinal direction of the heat absorption refrigerant passages 24 and the coolant passages 47 coincides with the longitudinal direction of the plate-like members 81.

The heat absorption refrigerant passages 24 and the coolant passages 47 are alternately disposed one by one in a stacking manner in the plate stacking direction (that is, parallelly disposed). The plate-like member 81 serves as a partition wall that separates the heat absorption refrigerant passage 24 and the coolant passage 47. Heat exchange between the refrigerant flowing through the heat absorption refrigerant passage 24 and the coolant flowing through the coolant passage 47 is performed through the plate-like member 81. The heat absorption evaporation unit 70 is configured so that the flow of the refrigerant flowing through the heat absorption refrigerant passage 24 and the flow of the coolant flowing through the coolant passage 47 are opposite to each other (so-called counterflow).

The internal heat exchange unit 60 includes a plurality of high pressure refrigerant passages 14 through which the refrigerant flowing out of the refrigerant radiator 12 is allowed to flow and a plurality of low pressure refrigerant passages 26 through which the refrigerant sucked into the compressor 11 is allowed to flow. The high pressure refrigerant passages 14 and the low pressure refrigerant passages 26 are formed between the plurality of plate-like members 81. The longitudinal direction of the high pressure refrigerant passages 14 and the low pressure refrigerant passages 26 coincides with the longitudinal direction of the plate-like members 81.

The high pressure refrigerant passages 14 and the low pressure refrigerant passages 26 are alternately disposed one by one in a stacking manner in the plate stacking direction (that is, parallel disposed). The plate-like member 81 serves as a partition wall that separates the high pressure refrigerant passage 14 and the low pressure refrigerant passage 26. Heat exchange between the refrigerant flowing through the high pressure refrigerant passage 14 and the refrigerant flowing through the low pressure refrigerant passage 26 is performed through the plate-like member 81. The internal heat exchange unit 60 is configured so that the flow of the refrigerant flowing through the low pressure refrigerant passage 26 and the flow of the refrigerant flowing through the high pressure refrigerant passage 14 are opposite to each other (so-called counterflow).

The heat exchange unit 800 is provided with a heat absorption refrigerant tank 82 (refer to FIG. 3), a coolant tank, a high pressure refrigerant tank, and a low pressure refrigerant tank. In the present embodiment, the coolant tank, the high pressure refrigerant tank, and the low pressure refrigerant tank are not illustrated.

The heat absorption refrigerant tank 82 performs distribution or collection of the refrigerant with respect to the plurality of heat absorption refrigerant passages 24. The coolant tank performs distribution or collection of the coolant with respect to the plurality of coolant passages 47. The high pressure refrigerant tank performs distribution or collection of the refrigerant with respect to the plurality of high pressure refrigerant passages 14. The low pressure refrigerant tank performs distribution or collection of the refrigerant with respect to the plurality of low pressure refrigerant passages 26.

The plate-like member 81 includes a plurality of projections 83 each of which has a substantially cylindrical shape and projects toward the one side or the other side in the plate stacking direction. Between two plate-like members 81 adjacent to each other in the plate stacking direction, the inner face of the projection 83 of one of the plate-like members 81 and the outer face of the projection 83 of the other plate-like member 81 are joined together. The projections 83 joined in this manner form the heat absorption refrigerant tank 82, the coolant tank, the high pressure refrigerant tank, and the low pressure refrigerant tank.

In the present embodiment, the heat absorption evaporation unit 70 and the internal heat exchange unit 60 are disposed side by side in the plate longitudinal direction. Thus, the heat absorption refrigerant passage 24 or the coolant passage 47 and the high pressure refrigerant passage 14 or the low pressure refrigerant passage 26 are disposed between the plurality of plate-like members 81.

Inner fins 84 are disposed between the plate-like members 81. The inner fins 84 are interposed between the plate-like members 81 to accelerate heat exchange between the heat absorption refrigerant and the coolant and between the low pressure refrigerant and the high pressure refrigerant. For example, an offset fin can be employed as the inner fin 84.

As illustrated in FIG. 2, the combined heat exchanger 80 includes a high pressure refrigerant outlet port 61, a low pressure refrigerant inlet port 62, a high pressure refrigerant inlet port 63, a low pressure refrigerant outlet port 64, a heat absorption refrigerant inlet port 71, a coolant inlet port 72, and a coolant outlet port 73.

The high pressure refrigerant outlet port 61 allows the refrigerant flowing out of the high pressure refrigerant passage 14 of the internal heat exchange unit 60 to flow out to the cooling refrigerant passage 200 of the cooling evaporation unit 20. The low pressure refrigerant inlet port 62 allows the refrigerant flowing out of the cooling refrigerant passage 200 of the cooling evaporation unit 20 to flow into the low pressure refrigerant passage 26 of the internal heat exchange unit 60.

The high pressure refrigerant inlet port 63 allows the refrigerant flowing out of the refrigerant radiator 12 to flow into the high pressure refrigerant passage 14 of the internal heat exchange unit 60. The low pressure refrigerant outlet port 64 allows the refrigerant flowing out of the low pressure refrigerant passage 26 of the internal heat exchange unit 60 to flow out to the suction side of the compressor 11.

The heat absorption refrigerant inlet port 71 allows the coolant flowing out of the high pressure refrigerant passage 14 of the internal heat exchange unit 60 to flow into the heat absorption refrigerant passage 24 of the heat absorption evaporation unit 70 in the heating mode. The coolant inlet port 72 allows the coolant discharged from the pressure pump 42 to flow into the coolant passage 47 of the heat absorption evaporation unit 70. The coolant outlet port 73 allows the refrigerant flowing out of the coolant passage 47 of the heat absorption evaporation unit 70 to flow out to the second radiator 43 side or the onboard device 44 side in the heating medium circulation passage 41.

In the plurality of plate-like members 81, the plate-like members 81 that form the outermost part in the plate stacking direction of the heat exchange unit are referred to as outer plate-like members 81A, 81B. Further, the outer plate-like member 81A which is disposed on one side in the plate stacking direction is referred to as the first outer plate-like member 81A, and the outer plate-like member 81B which is disposed on the other side in the plate stacking direction is referred to as the second outer plate-like member 81B.

The high pressure refrigerant outlet port 61, the low pressure refrigerant inlet port 62, the heat absorption refrigerant inlet port 71, and the coolant outlet port 73 are disposed on the plate surface of the first outer plate-like member 81A. The high pressure refrigerant inlet port 63, the low pressure refrigerant outlet port 64, and the coolant inlet port 72 are disposed on the plate surface of the second outer plate-like member 81.

A connection refrigerant passage 85 is formed between the first outer plate-like member 81A and the plate-like member 81 adjacent to the first outer plate-like member 81A. The connection refrigerant passage 85 connects the most downstream part of the heat absorption refrigerant passage 24 in the heat absorption evaporation unit 70 to the most upstream part of the low pressure refrigerant passage 26 in the internal heat exchange unit 60. The low pressure refrigerant inlet port 62 communicates with the connection refrigerant passage 85.

Thus, in the connection refrigerant passage 85, a refrigerant flow flowing from the low pressure refrigerant inlet port 62 (that is, the refrigerant flowing out of the cooling refrigerant passage 200 of the cooling evaporation unit 20) and a refrigerant flow flowing out of the heat absorption refrigerant passage 24 are merged into one refrigerant flow. That is, the refrigerant flow flowing out of the cooling refrigerant passage 200 of the cooling evaporation unit 20 and the refrigerant flow flowing out of the heat absorption refrigerant passage 24 are merged into one refrigerant flow inside the combined heat exchanger 80. In other words, the refrigerant merging unit 25 of the refrigeration cycle apparatus 10 is disposed inside the combined heat exchanger 80.

As described above, in the present embodiment, the refrigeration cycle apparatus 10 (more specifically, the heat exchange unit 800 of the combined heat exchanger 80) is provided with the internal heat exchange unit 60 which exchanges heat between the low-pressure refrigerant flowing out of the heating unit 30 and the high-pressure refrigerant sucked into the compressor 11. Accordingly, it is possible to increase a heat absorption amount of the refrigerant in at least one of the cooling evaporation unit 20 and the heat absorption evaporation unit 70 to improve the coefficient of performance of the refrigeration cycle apparatus 10 to which the combined heat exchanger 80 is applied.

At this time, when the internal heat exchange unit 60 is independently disposed in the refrigeration cycle apparatus 10, an additional heat exchanger and a pipe for connecting the heat exchanger to another cycle constituent device are required, which results in a complicated cycle configuration.

On the other hand, the combined heat exchanger 80 of the present embodiment includes the heat exchange unit 800 in which the heat absorption evaporation unit 70 and the internal heat exchange unit 60 are integrated together, and also includes the high pressure refrigerant outlet port 61 and the low pressure refrigerant inlet port 62. Thus, the cycle configuration can be simplified even in the refrigeration cycle apparatus 10 provided with the internal heat exchange unit 60.

There is a commonality between the heat absorption evaporation unit 70 and the internal heat exchange unit 60 in that the heat absorption evaporation unit 70 and the internal heat exchange unit 60 are heat exchangers without air intervention. Thus, as with the present embodiment, the heat absorption evaporation unit 70 and the internal heat exchange unit 60 can be integrated together with a simple configuration in which both the heat absorption evaporation unit 70 and the internal heat exchange unit 60 are staked heat exchangers in which the plurality of plate-like members 81 are stacked and joined together.

Further, in the present embodiment, the combined heat exchanger 80 is provided with the low pressure refrigerant inlet port 62 which allows the refrigerant flowing out of the cooling refrigerant passage 200 of the cooling evaporation unit 20 to flow into the low pressure refrigerant passage 26 of the internal heat exchange unit 60. Accordingly, it is possible to allow both flows of the refrigerant divided into the heat absorption evaporation unit 70 side and the cooling evaporation unit 20 side by the refrigerant dividing unit 15 to flow into the low pressure refrigerant passage 26 of the internal heat exchange unit 60. Thus, the coefficient of performance of the refrigeration cycle apparatus 10 can be improved in both cases where the operation mode of the refrigeration cycle apparatus 10 is the cooling mode and where the operation mode is the heating mode.

Further, in the present embodiment, the high pressure refrigerant outlet port 61, the low pressure refrigerant inlet port 62, the high pressure refrigerant inlet port 63, and the low pressure refrigerant outlet port 64 are disposed on the plate surfaces of the outer plate-like members 81A, 81B which form the outermost part in the plate stacking direction of the heat exchange unit 800. Accordingly, the high pressure refrigerant outlet port 61, the low pressure refrigerant inlet port 62, the high pressure refrigerant inlet port 63, and the low pressure refrigerant outlet port 64 can be easily disposed in the combined heat exchanger 80.

Further, in the present embodiment, the size of the heat absorption evaporation unit 70 differs from the size of the internal heat exchange unit 60 in the combined heat exchanger 80. In this case, it is possible to optimize the size of the heat absorption evaporation unit 70 and the size of the internal heat exchange unit 60 in the entire heat exchange unit 800.

Further, in the present embodiment, the heat absorption evaporation unit 70 and the internal heat exchange unit 60 are disposed side by side in the direction perpendicular to the plate stacking direction. Accordingly, it is possible to form the most downstream part of the heat absorption refrigerant passage 24, the connection refrigerant passage 85, and the most upstream part of the low pressure refrigerant passage 26 by the same plate-like member 81. Thus, it is possible to reduce a pressure loss caused when the refrigerant passes through the connection refrigerant passage 85.

Further, in the present embodiment, the low pressure refrigerant inlet port 62 communicates with the connection refrigerant passage 85 which connects the most downstream part of the heat absorption refrigerant passage 24 to the most upstream part of the low pressure refrigerant passage 26. Accordingly, the refrigerant flow flowing from the low pressure refrigerant inlet port 62 (that is, the refrigerant flowing out of the cooling refrigerant passage 200 of the cooling evaporation unit 20) and the refrigerant flow flowing out of the heat absorption refrigerant passage 24 are merged into one refrigerant flow in the connection refrigerant passage 85.

Thus, both the refrigerant flowing out of the cooling refrigerant passage 200 of the cooling evaporation unit 20 and the refrigerant flowing out of the heat absorption refrigerant passage 24 can exchange heat with the high-pressure refrigerant in the internal heat exchange unit 60. Thus, it is possible to further increase the heat absorption amount of the refrigerant in the cooling evaporation unit 20. Accordingly, it is possible to further improve the coefficient of performance of the refrigeration cycle apparatus 10 to which the combined heat exchanger 80 is applied.

Second Embodiment

A second embodiment will be described with reference to FIG. 4. The second embodiment differs from the first embodiment in the configuration of a combined heat exchanger 80.

Figure 4:
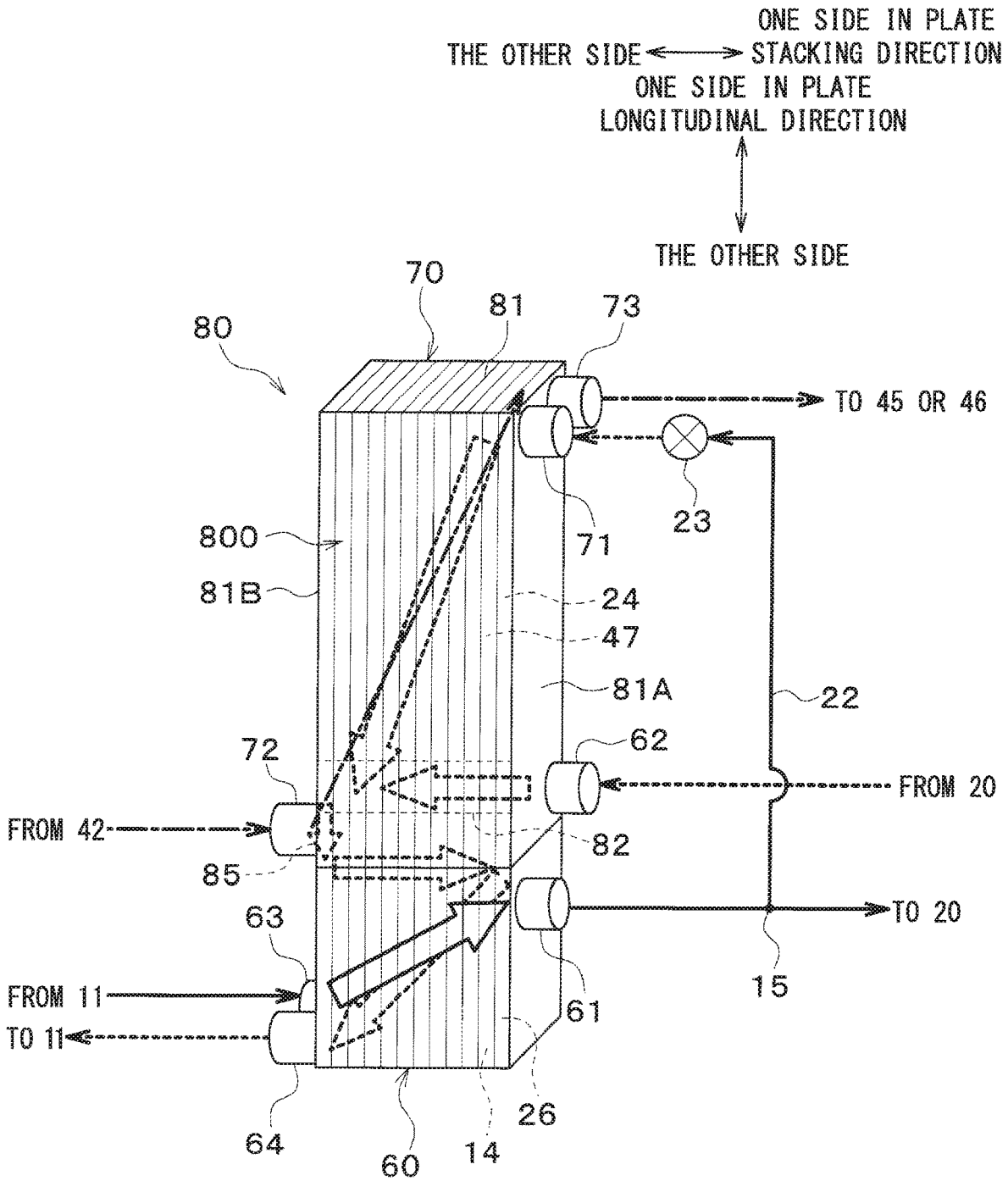
FIG. 4 is a view illustrating a combined heat exchanger according to a second embodiment.

As illustrated in FIG. 4, a connection refrigerant passage 85 of the present embodiment is formed between a second outer plate-like member 81B and a plate-like member 81 adjacent to the second outer plate-like member 81B.

A heat exchange unit 800 is provided with a heat absorption refrigerant tank 82 which performs collection of the refrigerant with respect to a plurality of heat absorption refrigerant passages 24. The heat absorption refrigerant tank 82 communicates with the connection refrigerant passage 85.

A low pressure refrigerant inlet port 62 communicates with the heat absorption refrigerant tank 82. More specifically, the low pressure refrigerant inlet port 62 communicates with the connection refrigerant passage 85 through the heat absorption refrigerant tank 82.

Thus, a refrigerant flow flowing from the low pressure refrigerant inlet port 62 (that is, the refrigerant flow flowing out of a cooling refrigerant passage 200 of a cooling evaporation unit 20) and a refrigerant flow flowing out of the heat absorption refrigerant passage 24 are merged into one refrigerant flow in the heat absorption refrigerant tank 82. That is, the refrigerant flow flowing out of the cooling refrigerant passage 200 of the cooling evaporation unit 20 and the refrigerant flow flowing out of the heat absorption refrigerant passage 24 are merged into one refrigerant flow inside the combined heat exchanger 80. In other words, the refrigerant merging unit 25 of the refrigeration cycle apparatus 10 is disposed inside the combined heat exchanger 80.

The other configurations and operations of the combined heat exchanger 80 and the refrigeration cycle apparatus 10 are similar to those of the first embodiment. Thus, it is possible to obtain effects similar to the effects of the first embodiment also in the combined heat exchanger 80 and the refrigeration cycle apparatus 10 of the present embodiment.

Third Embodiment

A third embodiment will be described with reference to FIGS. 5 and 6. The third embodiment differs from the first embodiment in the disposition of a low pressure refrigerant passage 26 of an internal heat exchange unit 60 and the configuration of a combined heat exchanger 80.

Figure 5:
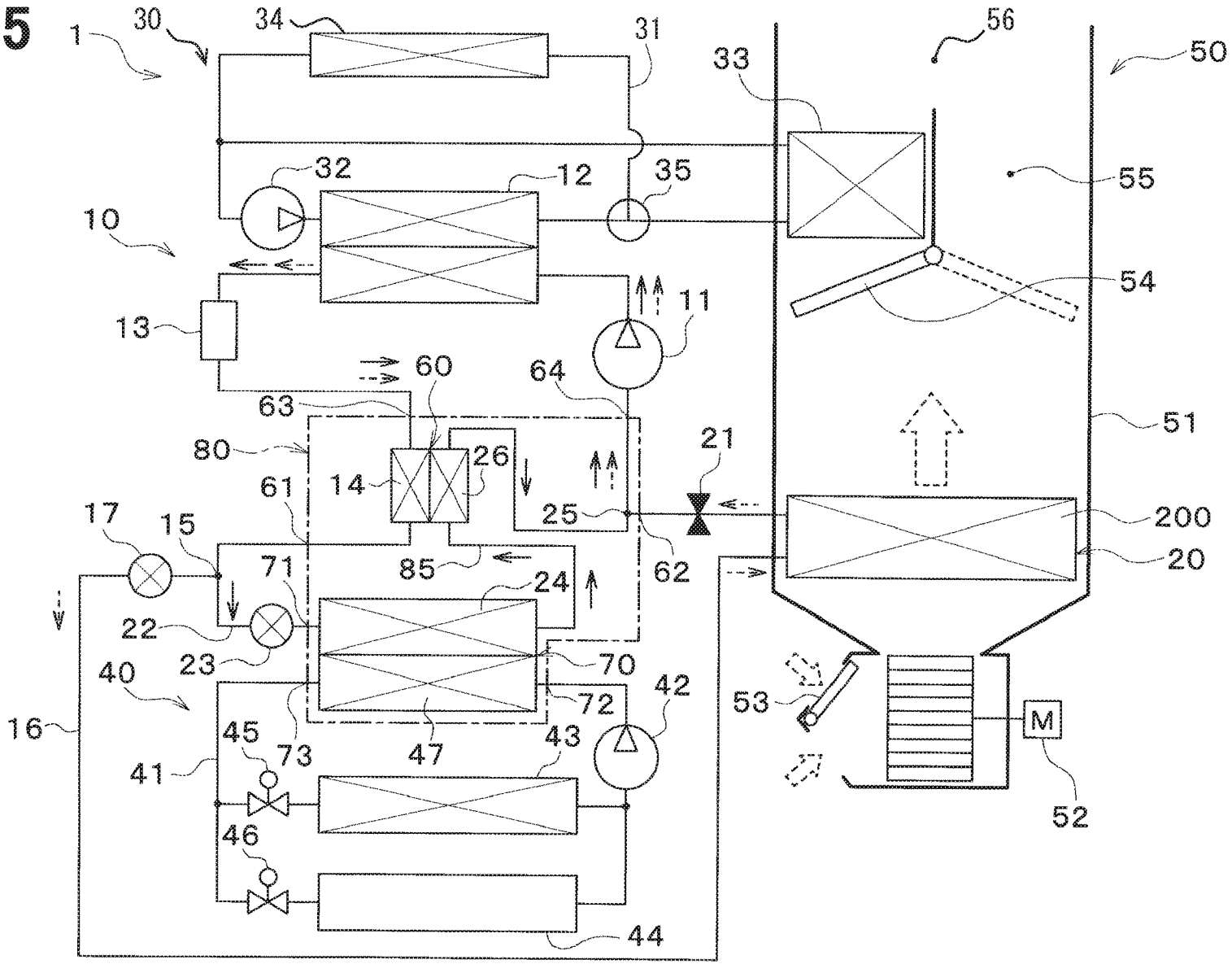
FIG. 5 is a schematic view illustrating a refrigeration cycle apparatus according to a third embodiment.
Figure 6:
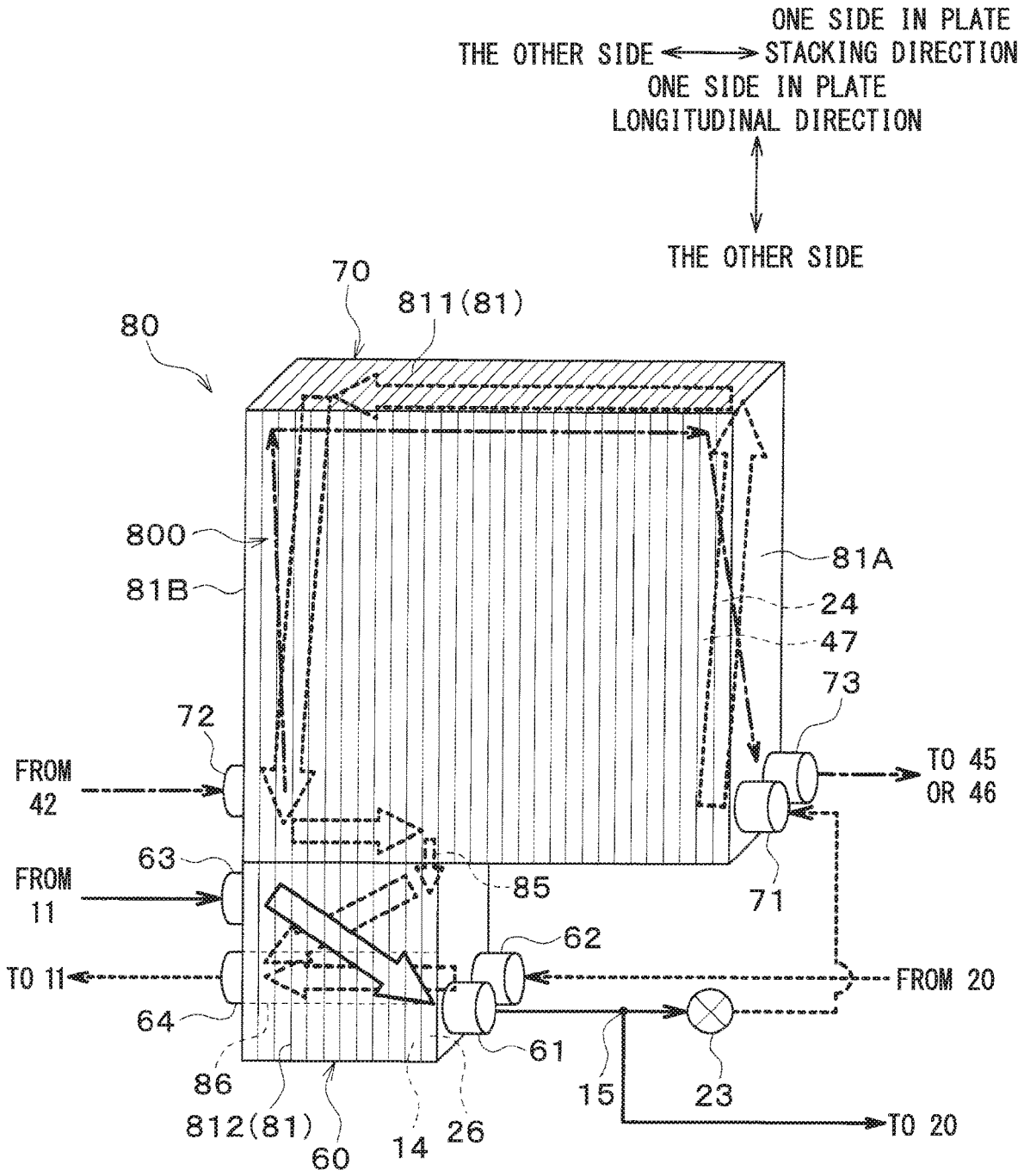
FIG. 6 is a view illustrating a combined heat exchanger of the third embodiment.

As illustrated in FIG. 5, in a refrigeration cycle apparatus 10 of the present embodiment, the low pressure refrigerant passage 26 of the internal heat exchange unit 60 is disposed on the refrigerant outlet side of a heat absorption evaporation unit 70 in a second parallel passage 22. That is, the low pressure refrigerant passage 26 of the internal heat exchange unit 60 is disposed between the heat absorption evaporation unit 70 and a refrigerant merging unit 25.

Next, an operating mode in a cooling mode of a vehicle air conditioner 1 according to the third embodiment will be described with reference to the drawings. In the cooling mode, the throttle opening degree of a first expansion valve 17 is determined to be a predetermined cooling mode opening degree which is previously determined. The throttle opening degree of a second expansion valve 23 is determined to be a fully-closed state. Accordingly, a switch to a refrigerant circuit indicated by a broken line arrow in FIG. 5 is made.

Thus, the refrigerant flowing out of a refrigerant dividing unit 15 flows into a first parallel passage 16, and does not flow into the second parallel passage 22. Thus, in the present embodiment, the refrigerant does not flow through the low pressure refrigerant passage 26 of the internal heat exchange unit 60. Thus, no heat exchange is performed between the high-pressure refrigerant flowing out of a refrigerant radiator 12 and the low-pressure refrigerant in the internal heat exchange unit 60.

Further, the refrigerant flowing out of a cooling evaporation unit 20 flows through an evaporation pressure regulating valve 21 and the refrigerant merging unit 25, and is sucked through a suction port of a compressor 11 and compressed again.

Next, an operating mode in a heating mode of the vehicle air conditioner 1 according to the third embodiment will be described with reference to the drawings. In the heating mode, the throttle opening degree of the second expansion valve 23 is determined to be a predetermined heating mode opening degree which is previously determined. The throttle opening degree of the first expansion valve 17 is determined to be a fully-closed state. Accordingly, a switch to a refrigerant circuit indicated by a solid line arrow in FIG. 5 is made.

Thus, in the present embodiment, the refrigerant flowing out of the refrigerant dividing unit 15 flows into the low pressure refrigerant passage 26 of the internal heat exchange unit 60 through the second expansion valve 23 and the heat absorption evaporation unit 70. The low-pressure refrigerant flowing into the low pressure refrigerant passage 26 of the internal heat exchange unit 60 exchanges heat with the high-pressure refrigerant flowing through a high pressure refrigerant passage 14 of the internal heat exchange unit 60 and reaches the refrigerant merging unit 25.

Next, the detailed configuration of the combined heat exchanger 80 in the refrigeration cycle apparatus 10 according to the third embodiment will be described with reference to FIG. 6.

In the combined heat exchanger 80, the length in the plate stacking direction of the heat absorption evaporation unit 70 is longer than the length in the plate stacking direction of the internal heat exchange unit 60. That is, the number of plate-like members 81 that form the heat absorption evaporation unit 70 is larger than the number of plate-like members 81 that form the internal heat exchange unit 60.

In the present embodiment, the heat absorption evaporation unit 70 and the internal heat exchange unit 60 each are formed by stacking and joining a plurality of plate-like members 81 of different types together. Hereinbelow, the plate-like members 81 forming the heat absorption evaporation unit 70 are referred to as heat absorption plate-like members 811, and the plate-like members 81 forming the internal heat exchange unit 60 are referred to as heat exchange plate-like members 812.

A heat absorption refrigerant inlet port 71 and a coolant outlet port 73 are disposed on the plate surface of one of the plurality of heat absorption plate-like members 811 that forms the outermost part on one side in the plate stacking direction. A coolant inlet port 72 is disposed on the plate surface of one of the plurality of heat absorption plate-like members 811 that forms the outermost part on the other side in the plate stacking direction.

A high pressure refrigerant outlet port 61 and a low pressure refrigerant inlet port 62 are disposed on the plate surface of one of the plurality of heat exchange plate-like members 812 that forms the outermost part on one side in the plate stacking direction. A high pressure refrigerant inlet port 63 and a low pressure refrigerant outlet port 64 are disposed on the plate surface of one of the plurality of heat exchange plate-like members 812 that forms the outermost part on the other side in the plate stacking direction.

The most upstream part of the low pressure refrigerant passage 26 of the internal heat exchange unit 60 is formed between the heat exchange plate-like member 812 that forms the outermost part on one side in the plate stacking direction of the internal heat exchange unit 60 and the heat exchange plate-like member 812 adjacent to the outermost heat exchange plate-like member 812. The connection refrigerant passage 85 is disposed on one side in the plate stacking direction of the internal heat exchange unit 60.

The heat exchange unit 800 is provided with a low pressure refrigerant tank 86 which communicates with the low pressure refrigerant outlet port 64 and collects flows of the refrigerant flowing out of a plurality of low pressure refrigerant passages 26. The low pressure refrigerant tank 86 extends from one side to the other side in the plate stacking direction.

The low pressure refrigerant inlet port 62 communicates with the low pressure refrigerant tank 86. The low pressure refrigerant inlet port 62 communicates with the low pressure refrigerant outlet port 64 through the low pressure refrigerant tank 86. In other words, the low pressure refrigerant inlet port 62 communicates with the most downstream part of the low pressure refrigerant passage 26.

Thus, a refrigerant flow flowing from the low pressure refrigerant inlet port 62 (that is, the refrigerant flow flowing out of the cooling refrigerant passage 200 of the cooling evaporation unit 20) and a refrigerant flow flowing out of the low pressure refrigerant passage 26 are merged into one refrigerant flow in the low pressure refrigerant tank 86. That is, the refrigerant flow flowing out of the cooling refrigerant passage 200 of the cooling evaporation unit 20 and the refrigerant flow flowing out of the low pressure refrigerant passage 26 are merged into one refrigerant flow inside the combined heat exchanger 80.

The refrigerant flowing out of the cooling refrigerant passage 200 of the cooling evaporation unit 20 flows through the inside of the low pressure refrigerant tank 86 of the combined heat exchanger 80, but does not flow through the low pressure refrigerant passage 26. Thus, in the combined heat exchanger 80, no heat exchange is performed between the refrigerant flowing out of the cooling refrigerant passage 200 of the cooling evaporation unit 20 and the refrigerant flowing through the high pressure refrigerant passage 14.

The other configurations and operations of the combined heat exchanger 80 and the refrigeration cycle apparatus 10 are similar to those of the first embodiment. Thus, it is possible to obtain effects similar to the effects of the first embodiment also in the combined heat exchanger 80 and the refrigeration cycle apparatus 10 of the present embodiment.

Further, in the present embodiment, the low pressure refrigerant passage 26 of the internal heat exchange unit 60 is disposed between the heat absorption evaporation unit 70 and the refrigerant merging unit 25. Thus, it is possible to increase the heat absorption amount of the refrigerant in one of the cooling evaporation unit 20 and the heat absorption evaporation unit 70 (in the present embodiment, the heat absorption evaporation unit 70) while integrating the internal heat exchange unit 60 and the heat absorption evaporation unit 70 together.

Fourth Embodiment

A fourth embodiment will be described with reference to FIGS. 7 and 8. The fourth embodiment differs from the third embodiment in the configuration of a combined heat exchanger 80.

Figure 7:
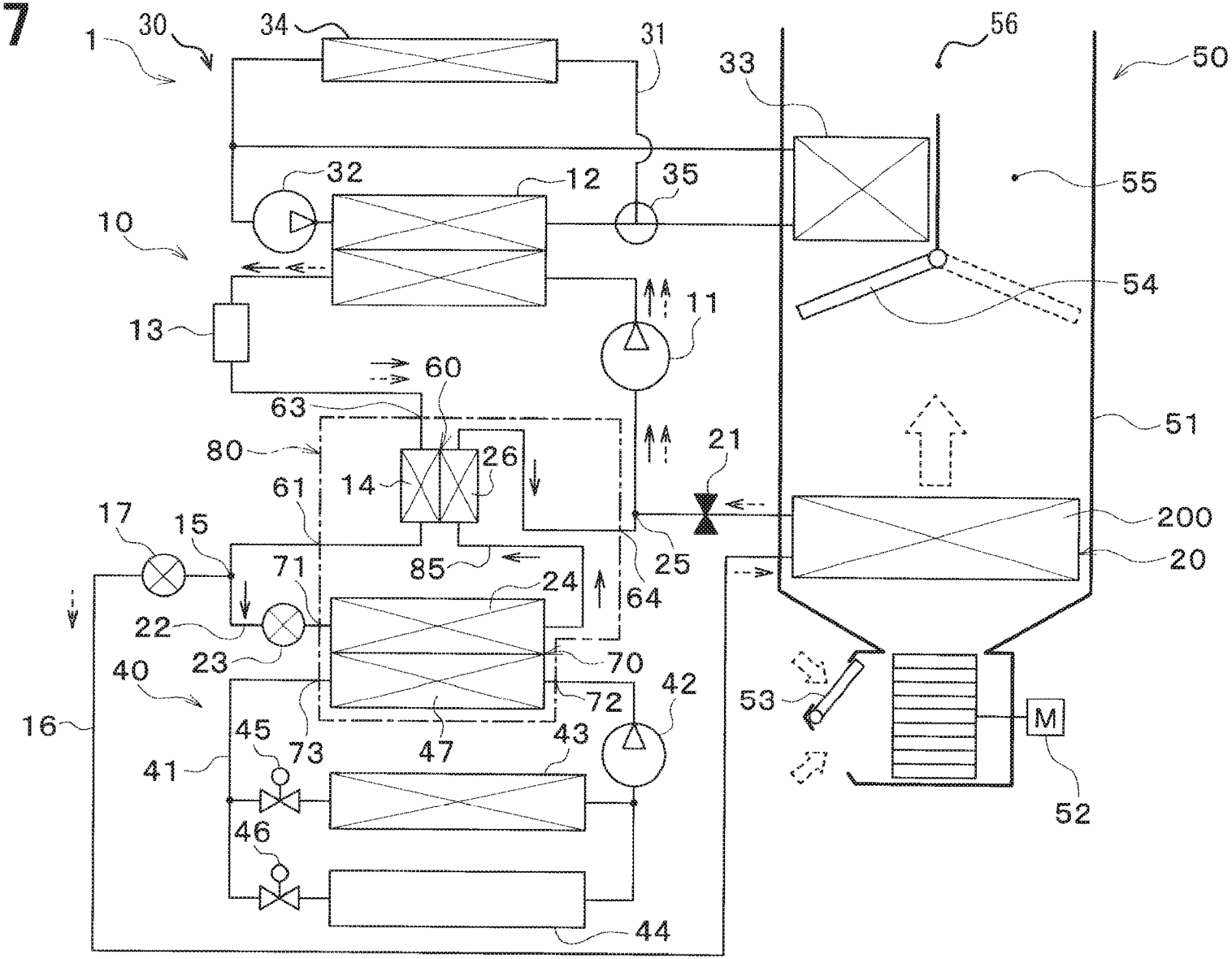
FIG. 7 is a schematic view illustrating a refrigeration cycle apparatus according to a fourth embodiment.

As illustrated in FIG. 7, in a refrigeration cycle apparatus 10 of the present embodiment, a refrigerant merging unit 25 is disposed outside the combined heat exchanger 80. That is, a refrigerant flow flowing out of a cooling refrigerant passage 200 of a cooling evaporation unit 20 and a refrigerant flow flowing out of a low pressure refrigerant passage 26 through a low pressure refrigerant outlet port 64 are merged into one refrigerant flow in the refrigerant merging unit 25 outside the combined heat exchanger 80.

Figure 8:
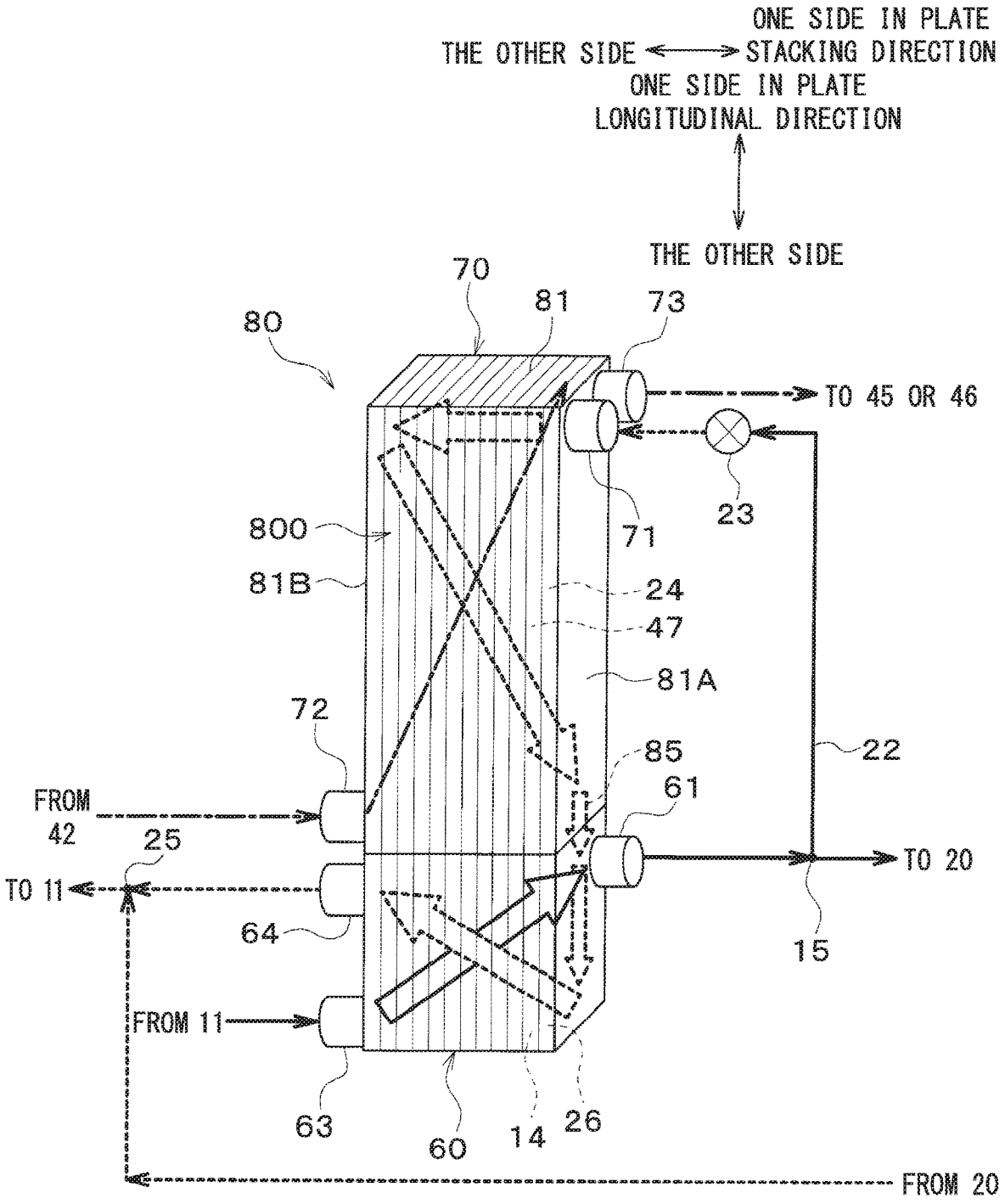
FIG. 8 is a view illustrating a combined heat exchanger of the fourth embodiment.

As illustrated in FIG. 8, a heat absorption evaporation unit 70 and an internal heat exchange unit 60 are formed by stacking and joining a plurality of plate-like members 81 of the same type together. That is, a heat absorption refrigerant passage 24 or a coolant passage 47 and a high pressure refrigerant passage 14 or the low pressure refrigerant passage 26 are formed between two adjacent plate-like members 81.

A high pressure refrigerant outlet port 61, a heat absorption refrigerant inlet port 71, and a coolant outlet port 73 are disposed on the plate surface of a first outer plate-like member 81A. A high pressure refrigerant inlet port 63, the low pressure refrigerant outlet port 64, and a coolant inlet port 72 are disposed on the plate surface of a second outer plate-like member 81B. A connection refrigerant passage 85 is formed between the first outer plate-like member 81A and the plate-like member 81 adjacent to the first outer plate-like member 81A.

The refrigerant flow flowing out of the cooling refrigerant passage 200 of the cooling evaporation unit 20 and the refrigerant flow flowing out of the low pressure refrigerant passage 26 through the low pressure refrigerant outlet port 64 are merged into one refrigerant flow in the refrigerant merging unit 25 outside the combined heat exchanger 80. Specifically, the refrigerant flow flowing out of the cooling refrigerant passage 200 of the cooling evaporation unit 20 and the refrigerant flow flowing out of the low pressure refrigerant passage 26 of the internal heat exchange unit 60 are merged into one refrigerant flow in a refrigerant pipe (not illustrated) on the downstream side of the combined heat exchanger 80.

The other configurations and operations of the combined heat exchanger 80 and the refrigeration cycle apparatus 10 are similar to those of the third embodiment. Thus, it is possible to obtain effects similar to the effects of the third embodiment also in the combined heat exchanger 80 and the refrigeration cycle apparatus 10 of the present embodiment.

Fifth Embodiment

A fifth embodiment will be described with reference to FIGS. 9 and 10. The fifth embodiment differs from the third embodiment in the disposition of a low pressure refrigerant passage 26 of an internal heat exchange unit 60 and the configuration of a combined heat exchanger 80.

Figure 9:
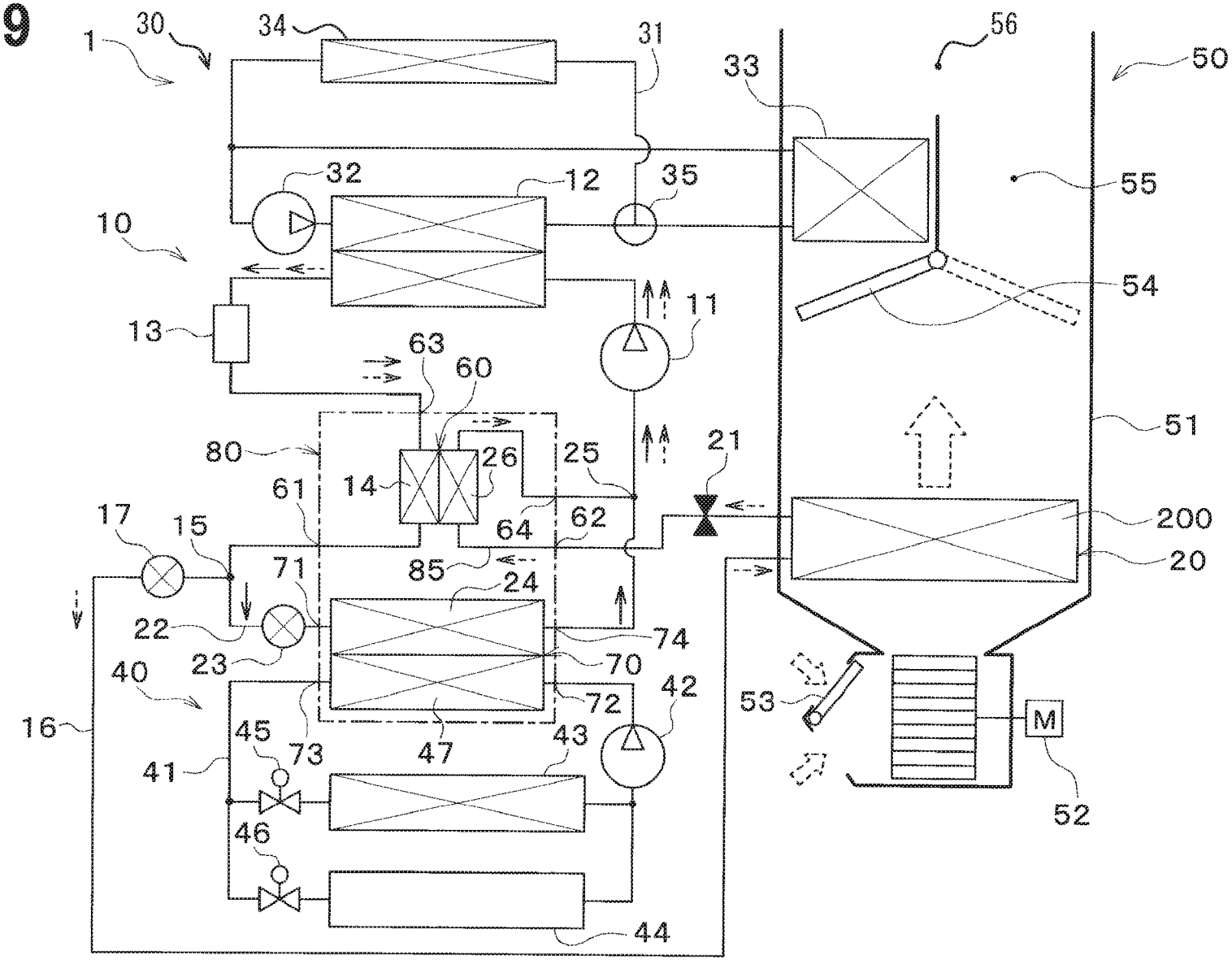
FIG. 9 is a schematic view illustrating a refrigeration cycle apparatus according to a fifth embodiment.
Figure 10:
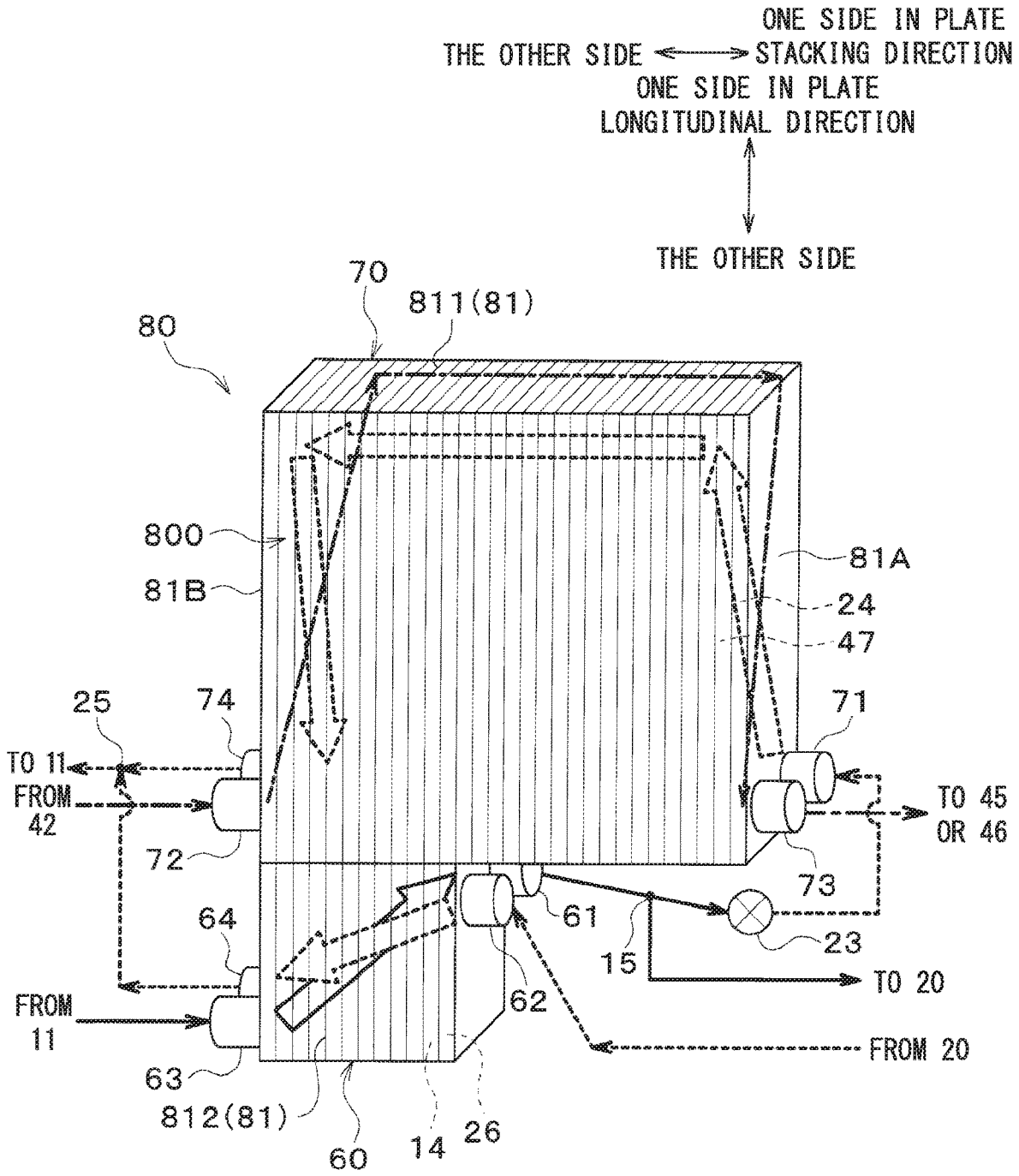
FIG. 10 is a view illustrating a combined heat exchanger of the fifth embodiment.

As illustrated in FIG. 9, in a refrigeration cycle apparatus 10 of the present embodiment, the low pressure refrigerant passage 26 of the internal heat exchange unit 60 is disposed on the refrigerant outlet side of an evaporation pressure regulating valve 21 in a first parallel passage 16. That is, the low pressure refrigerant passage 26 of the internal heat exchange unit 60 is disposed between the refrigerant outlet side of a cooling evaporation unit 20 (specifically, the evaporation pressure regulating valve 21) and a refrigerant merging unit 25.

Next, an operating mode in a cooling mode of a vehicle air conditioner 1 according to the fifth embodiment will be described with reference to the drawings. In the cooling mode, the throttle opening degree of a first expansion valve 17 is determined to be a predetermined cooling mode opening degree which is previously determined. The throttle opening degree of a second expansion valve 23 is determined to be a fully-closed state. Accordingly, a switch to a refrigerant circuit indicated by a broken line arrow in FIG. 9 is made.

Thus, in the present embodiment, the refrigerant flowing out of a refrigerant dividing unit 15 flows into the low pressure refrigerant passage 26 of the internal heat exchange unit 60 through the first expansion valve 17, the cooling evaporation unit 20, and the evaporation pressure regulating valve 21. The low-pressure refrigerant flowing into the low pressure refrigerant passage 26 of the internal heat exchange unit 60 exchanges heat with the high-pressure refrigerant flowing through a high pressure refrigerant passage 14 of the internal heat exchange unit 60 and reaches the refrigerant merging unit 25.

Next, an operating mode in a heating mode of the vehicle air conditioner 1 according to the fifth embodiment will be described with reference to the drawings. In the heating mode, the throttle opening degree of the second expansion valve 23 is determined to be a predetermined heating mode opening degree which is previously determined. The throttle opening degree of the first expansion valve 17 is determined to be a fully-closed state. Accordingly, a switch to a refrigerant circuit indicated by a solid line arrow in FIG. 9 is made.

Thus, the refrigerant flowing out of the refrigerant dividing unit 15 flows into a second parallel passage 22, and does not flow into the first parallel passage 16. Thus, in the present embodiment, the refrigerant does not flow through the low pressure refrigerant passage 26 of the internal heat exchange unit 60. Thus, no heat exchange is performed between the high-pressure refrigerant flowing out of a refrigerant radiator 12 and the low-pressure refrigerant in the internal heat exchange unit 60.

Next, the detailed configuration of the combined heat exchanger 80 in the refrigeration cycle apparatus 10 according to the fifth embodiment will be described with reference to FIG. 10.

The combined heat exchanger 80 of the present embodiment includes a heat absorption refrigerant outlet port 74. The heat absorption refrigerant outlet port 74 allows the refrigerant flowing out of a heat absorption refrigerant passage 24 of a heat absorption evaporation unit 70 to flow out to the suction side of a compressor 11. The heat absorption refrigerant outlet port 74 is disposed on the plate surface of one of a plurality of heat absorption plate-like members 811 that forms the outermost part on the other side in the plate stacking direction.

In the combined heat exchanger 80 of the present embodiment, the most downstream side of the heat absorption refrigerant passage 24 of the heat absorption evaporation unit 70 does not communicate with the most upstream part of the low pressure refrigerant passage 26 of the internal heat exchange unit 60. In other words, the heat absorption refrigerant passage 24 does not communicate with the low pressure refrigerant passage 26 inside the combined heat exchanger 80.

A refrigerant flow flowing out of the heat absorption refrigerant passage 24 through the heat absorption refrigerant outlet port 74 and a refrigerant flow flowing out of the low pressure refrigerant passage 26 through the low pressure refrigerant outlet port 64 are merged into one refrigerant flow in the refrigerant merging unit 25 outside the combined heat exchanger 80. Specifically, the refrigerant flow flowing out of the heat absorption refrigerant passage 24 and the refrigerant flow flowing out of the low pressure refrigerant passage 26 are merged into one refrigerant flow in a refrigerant pipe (not illustrated) on the downstream side of the combined heat exchanger 80.

The other configurations and operations of the combined heat exchanger 80 and the refrigeration cycle apparatus 10 are similar to those of the third embodiment. Thus, it is possible to obtain effects similar to the effects of the third embodiment also in the combined heat exchanger 80 and the refrigeration cycle apparatus 10 of the present embodiment.

Further, in the present embodiment, the low pressure refrigerant passage 26 of the internal heat exchange unit 60 is disposed between the refrigerant outlet side of the cooling evaporation unit 20 and the refrigerant merging unit 25. Thus, it is possible to increase the heat absorption amount of the refrigerant in one of the cooling evaporation unit 20 and the heat absorption evaporation unit 70 (in the present embodiment, the cooling evaporation unit 20) while integrating the internal heat exchange unit 60 and the heat absorption evaporation unit 70 together.

Sixth Embodiment

A sixth embodiment will be described with reference to FIGS. 11 and 12. The sixth embodiment differs from the fifth embodiment in the configuration of a combined heat exchanger 80.

Figure 11:
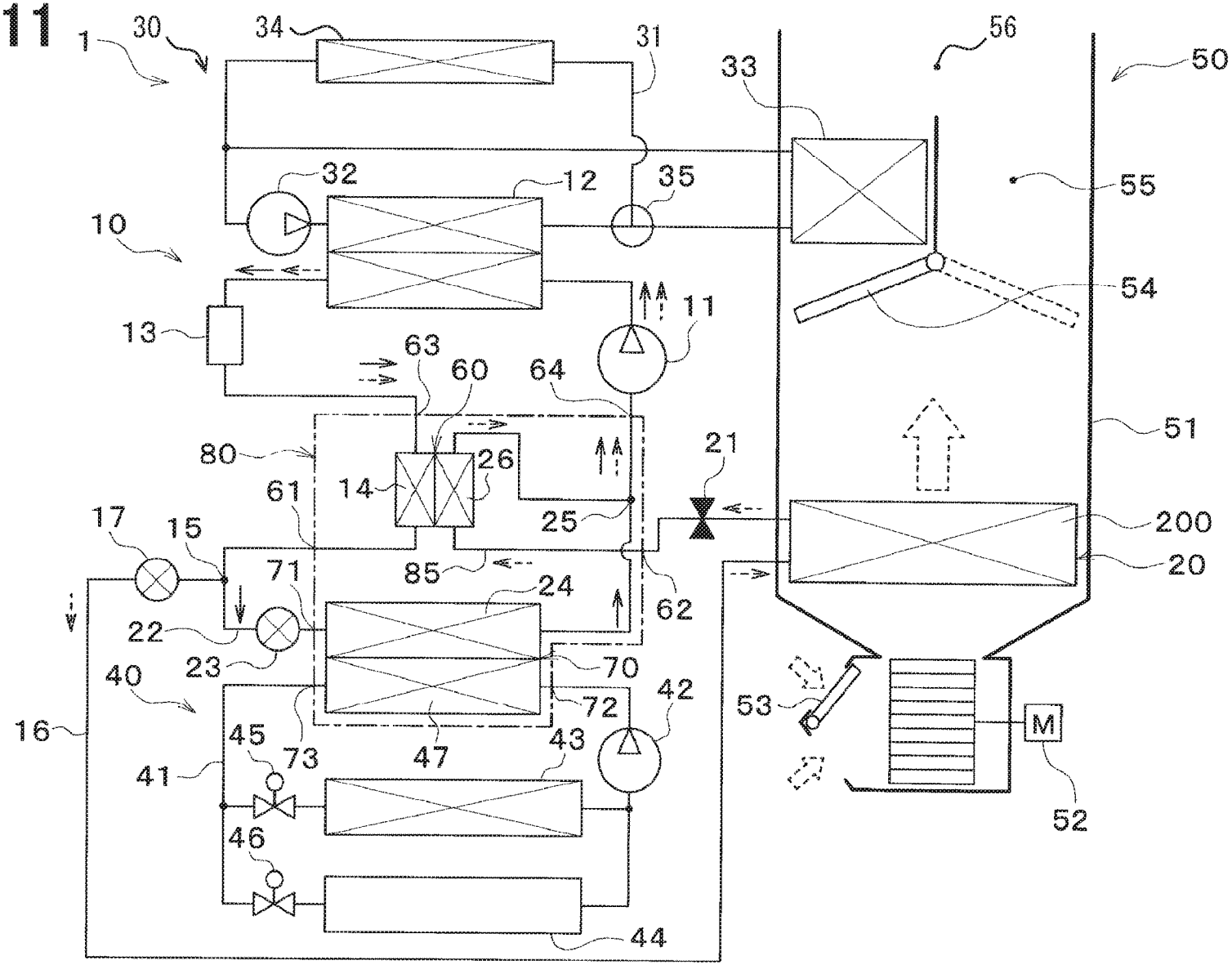
FIG. 11 is a schematic view illustrating a refrigeration cycle apparatus according to a sixth embodiment.

As illustrated in FIG. 11, in a refrigeration cycle apparatus 10 of the present embodiment, a refrigerant merging unit 25 is disposed inside the combined heat exchanger 80. That is, a refrigerant flow flowing out of a cooling refrigerant passage 200 of a cooling evaporation unit 20 and a refrigerant flow flowing out of a low pressure refrigerant passage 26 through a low pressure refrigerant outlet port 64 are merged into one refrigerant flow inside the combined heat exchanger 80.

Figure 12:
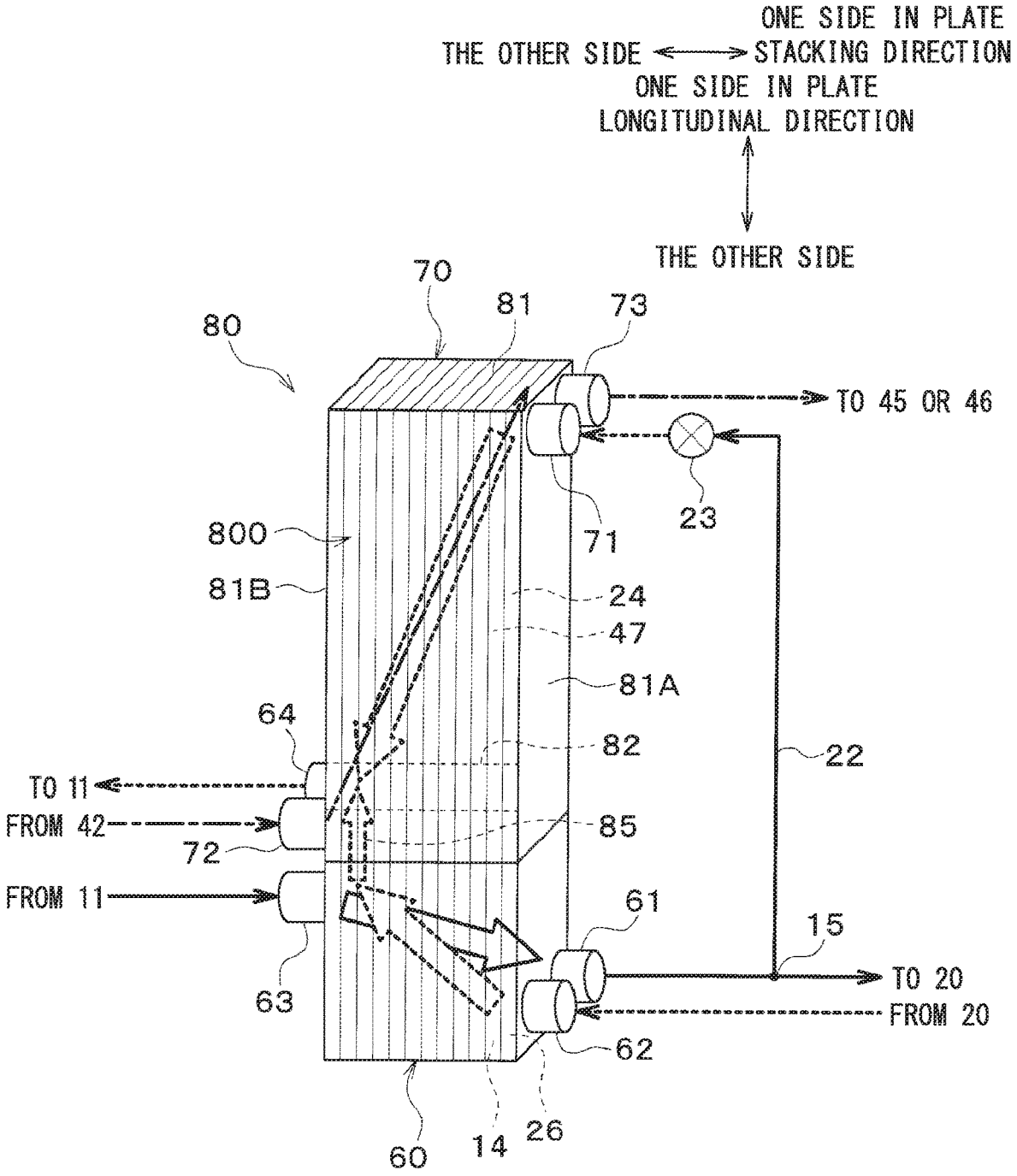
FIG. 12 is a view illustrating a combined heat exchanger of the sixth embodiment.

As illustrated in FIG. 12, a heat absorption evaporation unit 70 and an internal heat exchange unit 60 are formed by stacking and joining a plurality of plate-like members 81 of the same type together. That is, a heat absorption refrigerant passage 24 or a coolant passage 47 and a high pressure refrigerant passage 14 or the low pressure refrigerant passage 26 are formed between two adjacent plate-like members 81.

The combined heat exchanger 80 includes a connection refrigerant passage 85 which connects the most downstream part of the heat absorption refrigerant passage 24 in the heat absorption evaporation unit 70 to the most downstream part of the low pressure refrigerant passage 26 in the internal heat exchange unit 60. The connection refrigerant passage 85 is formed between a second outer plate-like member 81 and a plate-like member 81 adjacent to the second outer plate-like member 81.

A heat exchange unit 800 is provided with a heat absorption refrigerant tank 82 which performs collection of the refrigerant with respect to a plurality of heat absorption refrigerant passages 24. The heat absorption refrigerant tank 82 communicates with the connection refrigerant passage 85.

Thus, a refrigerant flow flowing out of the low pressure refrigerant passage 26 through the connection refrigerant passage 85 and a refrigerant flow flowing out of the heat absorption refrigerant passage 24 are merged into one refrigerant flow in the heat absorption refrigerant tank 82. That is, the refrigerant flow flowing out of the low pressure refrigerant passage 26 and the refrigerant flow flowing out of the heat absorption refrigerant passage 24 are merged into one refrigerant flow inside the combined heat exchanger 80.

The low pressure refrigerant outlet port 64 communicates with the heat absorption refrigerant tank 82. The refrigerant flowing out of the low pressure refrigerant passage 26 and the refrigerant flowing out of the heat absorption refrigerant passage 24 flow out to the suction side of a compressor 11 through the heat absorption refrigerant tank 82 and the low pressure refrigerant outlet port 64.

The other configurations and operations of the combined heat exchanger 80 and the refrigeration cycle apparatus 10 are similar to those of the fifth embodiment. Thus, it is possible to obtain effects similar to the effects of the fifth embodiment also in the combined heat exchanger 80 and the refrigeration cycle apparatus 10 of the present embodiment.

Seventh Embodiment

A seventh embodiment will be described with reference to FIG. 13. The seventh embodiment differs from the first embodiment in the configuration of a combined heat exchanger 80.

Figure 13:
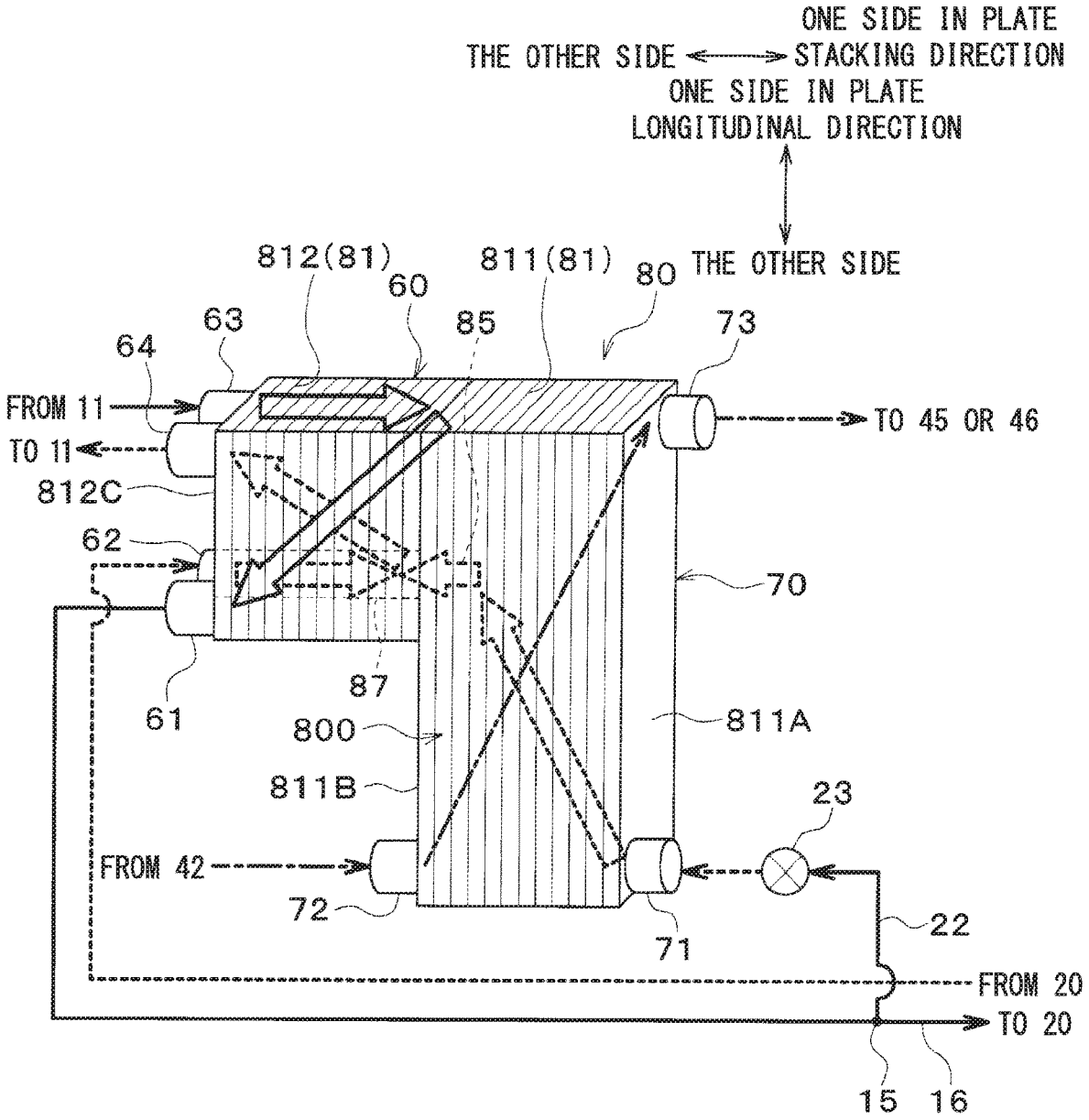
FIG. 13 is a view illustrating a combined heat exchanger of a seventh embodiment.

As illustrated in FIG. 13, in the combined heat exchanger 80 of the present embodiment, a heat absorption evaporation unit 70 and an internal heat exchange unit 60 are disposed side by side in the plate stacking direction. The length in the plate stacking direction of the heat absorption evaporation unit 70 is equal to the length in the plate stacking direction of the internal heat exchange unit 60. The length in the plate longitudinal direction of the heat absorption evaporation unit 70 is longer than the length in the plate longitudinal direction of the internal heat exchange unit 60.

Hereinbelow, in the plurality of plate-like members 81, plate-like members 81 forming the heat absorption evaporation unit 70 are referred to as heat absorption plate-like members 811, and plate-like members 81 forming the internal heat exchange unit 60 are referred to as heat exchange plate-like members 812. In the plurality of heat absorption plate-like members 811, the heat absorption plate-like member 811 that forms the outermost part on one side in the plate stacking direction is referred to as a first outer heat absorption plate-like member 811A, and the heat absorption plate-like member 811 that forms the outermost part on the other side in the plate stacking direction is referred to as a second outer heat absorption plate-like member 811B.

The internal heat exchange unit 60 is joined to the second outer heat absorption plate-like member 811B. Accordingly, the heat absorption evaporation unit 70 and the internal heat exchange unit 60 are integrated together.

A heat absorption refrigerant inlet port 71 and a coolant outlet port 73 are disposed on the plate surface of the first outer heat absorption plate-like member 811A. A coolant inlet port 72 is disposed on the plate surface of the second outer heat absorption plate-like member 811B. The coolant inlet port 72 is disposed in a part of the plate surface of the second outer heat absorption plate-like member 811B, the part being different from a part to which the internal heat exchange unit 60 is joined.

The outermost part on one side in the plate stacking direction of the internal heat exchange unit 60 is joined to the second outer heat absorption plate-like member 811B. Thus, the second outer heat absorption plate-like member 811B constitutes the outermost part on one side in the plate stacking direction of the internal heat exchange unit 60.

A high pressure refrigerant inlet port 63, a high pressure refrigerant outlet port 61, a low pressure refrigerant inlet port 62, and a low pressure refrigerant outlet port 64 are disposed on the plate surface of one of the plurality of heat exchange plate-like members 812 that forms the outermost part on the other side in the plate stacking direction.

A heat exchange unit 800 is provided with a low pressure refrigerant tank 87 which performs distribution of the refrigerant with respect to a plurality of low pressure refrigerant passages 26. The low pressure refrigerant tank 87 communicates with the low pressure refrigerant inlet port 62.

The combined heat exchanger 80 includes a connection refrigerant passage 85 which connects the most downstream part of a heat absorption refrigerant passage 24 in the heat absorption evaporation unit 70 to the low pressure refrigerant tank 87. The connection refrigerant passage 85 is formed between the second outer heat absorption plate-like member 811B and the heat absorption plate-like member 811 adjacent to the second outer heat absorption plate-like member 811B. The low pressure refrigerant inlet port 62 communicates with the connection refrigerant passage 85 through the low pressure refrigerant tank 87.

Thus, a refrigerant flow flowing from the low pressure refrigerant inlet port 62 (that is, the refrigerant flow flowing out of a cooling refrigerant passage 200 of a cooling evaporation unit 20) and a refrigerant flow flowing out of the heat absorption refrigerant passage 24 are merged into one refrigerant flow in the connection refrigerant passage 85. That is, the refrigerant flow flowing out of the cooling refrigerant passage 200 of the cooling evaporation unit 20 and the refrigerant flow flowing out of the heat absorption refrigerant passage 24 are merged into one refrigerant flow inside the combined heat exchanger 80.

The most downstream part of the heat absorption refrigerant passage 24 is formed by the second outer heat absorption plate-like member 811B and the heat absorption plate-like member 811 adjacent to the second outer heat absorption plate-like member 811B. Further, the most upstream part of the low pressure refrigerant passage 26 is formed by the second outer heat absorption plate-like member 811B and the heat exchange plate-like member 812 adjacent to the second outer heat absorption plate-like member 811B. Thus, in the combined heat exchanger 80 of the present embodiment, the plate-like member 811 that forms the most downstream part of the heat absorption refrigerant passage 24 and the plate-like member 812 that forms the most upstream part of the low pressure refrigerant passage 26 are adjacent to each other.

The connection refrigerant passage 85 and the low pressure refrigerant tank 87 are disposed on the same straight line. More specifically, the low pressure refrigerant tank 87 extends in the plate stacking direction, and the connection refrigerant passage 85 is connected to one side in the plate stacking direction of the low pressure refrigerant tank 87. Accordingly, it is possible to allow the refrigerant flowing out of the heat absorption refrigerant passage 24 to promptly flow into the low pressure refrigerant tank 87 through the connection refrigerant passage 85. Thus, it is possible to reduce a pressure loss caused when the refrigerant passes through the connection refrigerant passage 85.

The other configurations and operations of the combined heat exchanger 80 and the refrigeration cycle apparatus 10 are similar to those of the first embodiment. Thus, it is possible to obtain effects similar to the effects of the first embodiment also in the combined heat exchanger 80 and the refrigeration cycle apparatus 10 of the present embodiment.

Eighth Embodiment

Figure 14:
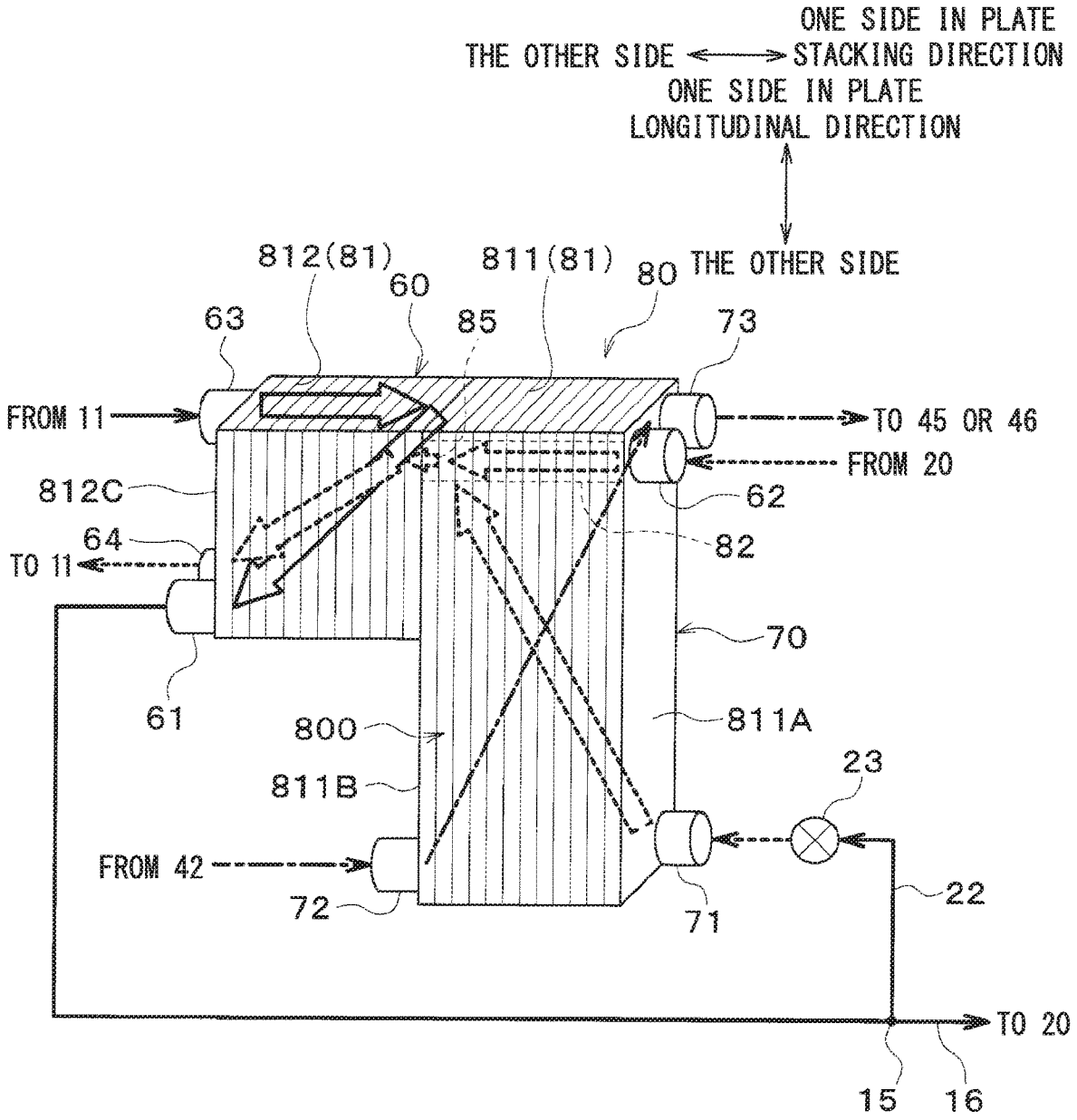
FIG. 14 is a view illustrating a combined heat exchanger of an eighth embodiment.

An eighth embodiment will be described with reference to FIG. 14. The eighth embodiment differs from the seventh embodiment in the configuration of a combined heat exchanger 80.

As illustrated in FIG. 12, in the combined heat exchanger 80 of the present embodiment, a heat exchange unit 800 is provided with a heat absorption refrigerant tank 82 which performs collection of the refrigerant with respect to a plurality of heat absorption refrigerant passages 24. The heat absorption refrigerant tank 82 communicates with a connection refrigerant passage 85.

A low pressure refrigerant inlet port 62 is disposed on the plate surface of a first outer heat absorption plate-like member 811A. A low pressure refrigerant inlet port 62 communicates with the heat absorption refrigerant tank 82. More specifically, the low pressure refrigerant inlet port 62 communicates with the connection refrigerant passage 85 through the heat absorption refrigerant tank 82.

Thus, a refrigerant flow flowing from the low pressure refrigerant inlet port 62 (that is, the refrigerant flow flowing out of a cooling refrigerant passage 200 of a cooling evaporation unit 20) and a refrigerant flow flowing out of the heat absorption refrigerant passage 24 are merged into one refrigerant flow in the heat absorption refrigerant tank 82.

The other configurations and operations of the combined heat exchanger 80 and the refrigeration cycle apparatus 10 are similar to those of the first embodiment. Thus, it is possible to obtain effects similar to the effects of the first embodiment also in the combined heat exchanger 80 and the refrigeration cycle apparatus 10 of the present embodiment.

Other Embodiments

The present disclosure is not limited to the above embodiments, and can be variously modified, for example, as described below, without departing from the gist of the present disclosure. Further, means disclosed in the above embodiments may be appropriately combined within an enabling range.

(1) In the above embodiments, outside air or the onboard device 44 is employed as the external heat source whose heat is absorbed by the heat absorption evaporation unit 70. However, the present disclosure is not limited to this mode. For example, the onboard device 44 is also not limited to the device described above, and various heat sources such as a battery for vehicle traveling and a vehicle engine can be used.

(2) In the above embodiments, the heating unit 30 is configured as the high temperature side heating medium circuit, and dissipates heat of the high-pressure refrigerant to outside air or ventilation air as the fluid to be heat-exchanged through the coolant as the heating medium. However, the present disclosure is not limited to this mode. For example, an indoor condenser may be employed as the heating heat exchanger in the present disclosure instead of the refrigerant radiator 12 in the above embodiments.

(3) In the above embodiments, the liquid storage unit 13 is disposed between the refrigerant radiator 12 and the internal heat exchange unit 60. However, the present disclosure is not limited to this mode. For example, the liquid storage unit 13 can also be disposed on the downstream side of the suction port of the compressor 11 and the upstream side of the internal heat exchange unit 60. In this case, the liquid storage unit 13 has a function of supplying a gas-phase refrigerant to the compressor 11 and reducing the supply of a liquid-phase refrigerant. Thus, it is possible to prevent liquid compression of the refrigerant in the compressor 11.

(4) In the above embodiments, the evaporation pressure regulating valve 21 is disposed on the downstream side in the refrigerant flow of the cooling evaporation unit 20 in the first parallel passage 18. However, the present disclosure is not limited to this mode. The refrigeration cycle apparatus 10 can also be configured without disposing the evaporation pressure regulating valve 21 depending on a combination of operation modes to be employed.

(5) In the above embodiments, the combined heat exchanger 80 includes at least the high pressure refrigerant outlet port 61 of the high pressure refrigerant outlet port 61 and the low pressure refrigerant inlet port 62. However, the present disclosure is not limited to this mode. For example, in the combined heat exchanger 80 which is applied to the refrigeration cycle apparatus 10 in which the high pressure refrigerant passage 14 of the internal heat exchange unit 60 is disposed on the downstream side of the refrigerant dividing unit 15, the high pressure refrigerant outlet port 61 can be eliminated.

(6) In the above embodiments, the cooling evaporation unit 20 and one heat absorption evaporation unit 70 are connected parallel to each other. However, the present disclosure is not limited to this mode. For example, the cooling evaporation unit 20 and a plurality of heat absorption evaporation units 70 may be connected parallel to each other.

(7) In the above embodiments, the high pressure refrigerant passage 14 of the internal heat exchange unit 60 is connected to the downstream side of the liquid storage unit 13. However, the present disclosure is not limited to this mode. For example, a subcooling heat exchanger, which exchanges heat between a liquid-phase refrigerant flowing out of the liquid storage unit 13 and outside air to subcool the liquid-phase refrigerant, may be disposed between the liquid storage unit 13 and the high pressure refrigerant passage 14 of the internal heat exchange unit 60.

(8) In the above embodiments, the first radiator 34 of the heating unit 30 and the second radiator 43 of the heating medium circuit 40 are configured as heat exchangers independent of each other. However, the present disclosure is not limited to this mode.

For example, outer fins of the first radiator 34 and the second radiator 43 may be shared, and the first radiator 34 and the second radiator 43 may be disposed so as to enable heat transfer between the heating mediums (that is, coolant). Further, the refrigeration cycle apparatus 10 may be configured so that the heating medium flowing through the first radiator 34 and the heating medium flowing through the second radiator 43 are mixed together.

(9) In the above embodiments, the refrigeration cycle apparatus 10 is capable of switching the operation mode between the cooling mode and the heating mode. However, switching of the operation mode of the refrigeration cycle apparatus 10 is not limited thereto.

For example, in the refrigeration cycle apparatus 10 described in the first embodiment, the cooling evaporation unit 20 cools ventilation air in a manner similar to the cooling mode. Further, the opening degree of the air mix door 54 may be changed to reheat the ventilation air that has been cooled and dehumidified in the cooling evaporation unit 20 by the heater core 33, and the reheated ventilation air may be blown out to the space to be air-conditioned. Accordingly, it is possible to switch the operation mode to a dehumidification heating mode which achieves dehumidification heating in the space to be air-conditioned.

For example, in the refrigeration cycle apparatus 10 described in the first embodiment, heat of the onboard device 44 is absorbed in a manner similar to the heating mode. Further, in a manner similar to the heating mode, the entire coolant flowing out of the refrigerant radiator 12 may be caused to flow into the first radiator 34. Accordingly, it is possible to switch the operation mode to a device cooling mode which dissipates heat generated by the onboard device 44 to outside air by the first radiator 34 without performing temperature control of ventilation air.

(10) In the above sixth embodiment, the refrigerant flow flowing out of the low pressure refrigerant passage 26 and the refrigerant flow flowing out of the heat absorption refrigerant passage 24 through the connection refrigerant passage 85 are merged into one refrigerant flow in the heat absorption refrigerant tank 82 of the heat absorption evaporation unit 70. However, the present disclosure is not limited to this mode.

For example, the low pressure refrigerant outlet port 64 may be disposed communicating with the low pressure refrigerant tank, and the refrigerant flow flowing out of the low pressure refrigerant passage 26 and the refrigerant flow flowing out of the heat absorption refrigerant passage 24 through the connection refrigerant passage 85 may be merged into one refrigerant flow in the low pressure refrigerant tank.

What is claimed is:

1. A combined heat exchanger for a vapor compression refrigeration cycle apparatus, the refrigeration cycle apparatus including a compressor that compresses and discharges a refrigerant, a heating unit that heats a fluid to be heat-exchanged using the refrigerant discharged from the compressor as a heat source, and a cooling evaporation unit that absorbs heat of the fluid to be heat-exchanged into the refrigerant to evaporate the refrigerant, the combined heat exchanger comprising a heat exchange unit including a plurality of plate-like members stacked and joined together, wherein the heat exchange unit includes a heat absorption evaporation unit that absorbs heat of a heating medium into the refrigerant to evaporate the refrigerant, and an internal heat exchange unit that exchanges heat between the refrigerant flowing out of the heating unit and the refrigerant sucked into the compressor, the heat absorption evaporation unit includes a heat absorption refrigerant passage through which the refrigerant is allowed to flow, the cooling evaporation unit includes a cooling refrigerant passage through which the refrigerant is allowed to flow, the internal heat exchange unit includes a high pressure refrigerant passage through which the refrigerant flowing out of the heating unit is allowed to flow and a low pressure refrigerant passage through which the refrigerant sucked into the compressor is allowed to flow, the heat absorption refrigerant passage and the cooling refrigerant passage are connected parallel to each other, and the combined heat exchanger has at least one of a high pressure refrigerant outlet port that allows the refrigerant flowing out of the high pressure refrigerant passage to flow out to the cooling refrigerant passage and a low pressure refrigerant inlet port that allows the refrigerant flowing out of the cooling refrigerant passage to flow into the low pressure refrigerant passage.

2. The combined heat exchanger according to claim 1, further comprising:

a high pressure refrigerant inlet port that allows the refrigerant flowing out of the heating unit to flow into the high pressure refrigerant passage; and a low pressure refrigerant outlet port that allows the refrigerant flowing out of the low pressure refrigerant passage to flow out to a suction side of the compressor.

3. The combined heat exchanger according to claim 1, wherein at least one of the high pressure refrigerant outlet port, the low pressure refrigerant inlet port, the high pressure refrigerant inlet port, and the low pressure refrigerant outlet port is disposed on a plate surface of one of the plate-like members that forms an outermost part in a stacking direction of the heat exchange unit.

4. The combined heat exchanger according to claim 1, wherein a size of the heat absorption evaporation unit differs from a size of the internal heat exchange unit.

5. The combined heat exchanger according to claim 1, wherein the heat absorption evaporation unit and the internal heat exchange unit are disposed side by side in a direction perpendicular to a stacking direction of the plurality of plate-like members.

6. The combined heat exchanger according to claim 1, wherein the heat absorption evaporation unit and the internal heat exchange unit are disposed side by side in a stacking direction of the plurality of plate-like members.

7. The combined heat exchanger according to claim 6, wherein one of the plate-like members that forms a most downstream part of the heat absorption refrigerant passage and one of the plate-like members that forms a most upstream part of the low pressure refrigerant passage are adjacent to each other.

8. The combined heat exchanger according to claim 1, wherein the low pressure refrigerant inlet port communicates with a connection refrigerant passage that connects a most downstream part of the heat absorption refrigerant passage to a most upstream part of the low pressure refrigerant passage.

9. The combined heat exchanger according to claim 1, wherein the low pressure refrigerant inlet port communicates with a most downstream part of the low pressure refrigerant passage.

* * * * *